US012716632B2

(12) United States Patent
Kilgo

(10) Patent No.: US 12,716,632 B2
(45) Date of Patent: Aug. 25, 2026

(54) REFRIGERANT LEAK MITIGATION SYSTEM

(71) Applicant: Trane International Inc., Davidson, NC (US)

(72) Inventor: Richard S. Kilgo, Whitehouse, TX (US)

(73) Assignee: Trane International Inc., Davidson, NC (US)

( * ) Notice: Subject to any disclaimer, the term of this patent is extended or adjusted under 35 U.S.C. 154(b) by 364 days.

(21) Appl. No.: 17/447,912

(22) Filed: Sep. 16, 2021

(65) Prior Publication Data

US 2023/0080672 A1 Mar. 16, 2023

(51) Int. Cl.
*F25B 49/02* (2006.01)
*F25B 41/20* (2021.01)

(52) U.S. Cl.
CPC ..... *F25B 49/02* (2013.01); *F25B 41/20* (2021.01); *F25B 2500/222* (2013.01);
(Continued)

(58) Field of Classification Search
CPC ..... F25B 49/02; F25B 41/20; F25B 41/31; F25B 2500/222; F25B 2500/221;
(Continued)

(56) References Cited

U.S. PATENT DOCUMENTS 1,885,838 A * 11/1932 Kellogg ..... F25B 41/315 62/515
2,763,131 A * 9/1956 Sorensen ..... 62/3
(Continued)

FOREIGN PATENT DOCUMENTS

BR 112019010410 A2 9/2019
CA 3065728 A1 3/2020
(Continued)

OTHER PUBLICATIONS

US 11,402,122 B2, 08/2022, Tsuji et al. (withdrawn)
(Continued)

*Primary Examiner* — Frantz F Jules
*Assistant Examiner* — Devon Moore
(74) *Attorney, Agent, or Firm* — Womble Bond Dickinson (US) LLP

(57) ABSTRACT

Example embodiments of the present disclosure relate to an HVAC system, and methods for controlling the system, that mitigate the impact of refrigerant leaks before the leaks are even detected. Some embodiments include an HVAC system operable to mitigate refrigerant leaks, the system including an indoor unit including an indoor fan and an indoor heat exchanger, an outdoor unit including an outdoor heat exchanger and a compressor, a refrigerant circuit including a refrigerant circulated between the indoor unit and the outdoor unit, a mass control valve coupled to the refrigerant circuit, and control circuitry configured to: operate the HVAC system to satisfy a conditioning load by circuiting the refrigerant through the refrigerant circuit and operating the indoor fan, and completely close the mass control valve to at least partially isolate the refrigerant circuit at the indoor heat exchanger in response to the indoor fan being shut off.

20 Claims, 7 Drawing Sheets

(52) U.S. Cl.
CPC ... *F25B 2600/2515* (2013.01); *F25B 2700/13* (2013.01); *F25B 2700/19* (2013.01); *F25B 2700/21* (2013.01)

(58) Field of Classification Search
CPC ..... F25B 2500/22; F25B 2600/2515; F25B 2700/13; F25B 2700/19; F25B 2700/21; F25B 2600/2513
See application file for complete search history.

(56) References Cited

U.S. PATENT DOCUMENTS 3,350,895 A * 11/1967 Harnish ..... F25B 47/022 62/197
3,766,844 A 10/1973 Donnelly et al.
4,138,856 A 2/1979 Orlowski
4,262,736 A * 4/1981 Gilkeson ..... F25B 49/02 236/94
4,574,615 A 3/1986 Bower et al.
4,711,096 A 12/1987 Krantz
4,879,546 A 11/1989 Dunham et al.
4,896,052 A 1/1990 Morrison et al.
4,987,769 A 1/1991 Peacock et al.
5,060,507 A 10/1991 Urmson et al.
5,090,507 A 2/1992 Olson et al.
5,264,368 A 11/1993 Clarke et al.
5,325,703 A 7/1994 Magori
5,335,513 A 8/1994 Campbell et al.
5,473,934 A 12/1995 Cobb
5,710,377 A 1/1998 Youngquist et al.
5,742,066 A 4/1998 Cavestri
5,820,262 A 10/1998 Lechner
5,918,475 A 7/1999 Sakakibara et al.
5,955,670 A 9/1999 Goodman et al.
6,085,531 A 7/2000 Numoto et al.
6,279,378 B1 8/2001 Sheen et al.
6,471,136 B1 10/2002 Chatterjee et al.
6,644,047 B2 11/2003 Taira et al.
6,655,161 B1 12/2003 Koo
6,701,722 B1 3/2004 Seo et al.
6,742,384 B2 6/2004 Avila
6,772,598 B1 8/2004 Rinehart
6,791,088 B1 9/2004 Williams, II et al.
6,889,537 B2 5/2005 Anderson
7,143,591 B2 12/2006 Nonaka et al.
7,181,954 B2 2/2007 Horie
7,631,508 B2 12/2009 Braun et al.
7,647,784 B2 1/2010 Mizutani et al.
7,752,853 B2 7/2010 Singh et al.
7,814,757 B2 10/2010 Zima et al.
7,946,121 B2 5/2011 Yamaguchi et al.
7,987,679 B2 8/2011 Tanaka et al.
8,005,648 B2 8/2011 Johnson et al.
8,070,355 B2 12/2011 Minor et al.
8,180,495 B1 5/2012 Roy
8,302,414 B2 11/2012 Hisaoka
8,402,779 B2 3/2013 Nishimura et al.
8,570,179 B2 10/2013 Holloway et al.
8,590,325 B2 11/2013 Pham
8,695,404 B2 4/2014 Kadle et al.
8,786,437 B2 7/2014 Breed
8,899,099 B2 12/2014 Grosse Bley et al.
9,164,519 B2 10/2015 Holloway
9,291,378 B2 3/2016 Ueda et al.
9,482,592 B2 11/2016 Huseynov et al.
9,541,319 B2 1/2017 Morimoto et al.
9,568,227 B2 2/2017 Douglas et al.
9,625,195 B2 4/2017 Hiraki et al.
9,726,410 B2 8/2017 Gao et al.
9,791,195 B2 10/2017 Okada et al.
9,869,499 B2 1/2018 Liu et al.
10,088,202 B2 10/2018 Huff et al.
10,126,012 B2 11/2018 Ikawa et al.
10,126,031 B2 11/2018 Shockley
10,151,663 B2 12/2018 Scancarello
10,182,040 B2 1/2019 Hu et al.
10,203,136 B2 2/2019 Nishimura et al.
10,247,441 B2 4/2019 Suzuki et al.
10,352,602 B2 7/2019 Kates
10,354,332 B2 7/2019 Trainor et al.
10,399,412 B2 9/2019 Mathe et al.
10,401,253 B2 9/2019 Cooper et al.
10,408,484 B2 9/2019 Honda et al.
10,408,488 B2 9/2019 Suzuki et al.
10,416,113 B2 9/2019 Chen et al.
10,424,190 B2 9/2019 Zribi et al.
10,458,689 B2 10/2019 Suzuki
10,479,170 B2 11/2019 Enomoto et al.
10,480,807 B2 11/2019 Goel et al.
10,488,066 B2 11/2019 Honda et al.
10,488,072 B2 11/2019 Yajima et al.
10,508,847 B2 12/2019 Yajima et al.
10,539,358 B2 1/2020 Suzuki et al.
10,557,648 B2 2/2020 Naito et al.
10,584,890 B2 3/2020 Steinberg
10,605,505 B2 3/2020 Appler et al.
10,610,353 B2 4/2020 Jana et al.
10,634,404 B2 4/2020 Obara et al.
10,641,268 B2 5/2020 Brostrom et al.
10,655,884 B2 5/2020 Iura et al.
10,677,679 B2 6/2020 Gupte et al.
10,712,035 B2 7/2020 Yamada
10,714,772 B2 7/2020 Nishida et al.
10,724,766 B2 7/2020 Suzuki et al.
10,767,881 B2 9/2020 Wang
10,767,882 B2 9/2020 Kowald et al.
10,782,040 B2 9/2020 Wacker
10,808,960 B2 10/2020 Suzuki et al.
10,816,232 B2 10/2020 Crawford et al.
10,816,247 B2 10/2020 McQuade
10,823,445 B2 11/2020 Suzuki et al.
10,928,091 B2 2/2021 Crawford et al.
10,935,454 B2 3/2021 Kester
10,941,956 B2 3/2021 Gao et al.
10,996,131 B2 5/2021 McQuade et al.
11,002,467 B2 5/2021 Wada et al.
11,015,828 B2 5/2021 Sakae et al.
11,015,834 B2 5/2021 Kageyama et al.
11,015,852 B2 5/2021 Sakae et al.
11,022,346 B2 6/2021 Sun et al.
11,041,647 B2 6/2021 Weinert
11,041,666 B2 6/2021 Sakae et al.
11,067,303 B2 7/2021 Obara et al.
11,067,321 B2 7/2021 Suzuki
11,079,149 B2 8/2021 Papas et al.
11,079,300 B2 8/2021 Shi et al.
11,092,566 B2 8/2021 Chen
11,098,915 B2 8/2021 Crawford
11,117,449 B2 9/2021 Renault
11,118,821 B2 9/2021 Matsuda et al.
11,118,822 B2 9/2021 Kujak
11,125,457 B1 9/2021 Alfano
11,131,470 B2 9/2021 Minamida et al.
11,137,184 B2 10/2021 Yamada et al.
11,143,439 B2 10/2021 Matsuda et al.
11,150,156 B2 10/2021 Nanba et al.
11,162,725 B2 11/2021 Suzuki et al.
11,175,060 B2 11/2021 Mowris
11,193,685 B2 12/2021 Brahme et al.
11,199,337 B2 12/2021 Kawashima et al.
11,214,866 B2 1/2022 Soininen et al.
11,231,199 B2 1/2022 Ikeda et al.
11,248,816 B2 2/2022 Ikawa et al.
11,260,728 B2 3/2022 Kondrk
11,262,097 B2 3/2022 Suzuki
11,268,718 B2 3/2022 Minamida et al.
11,274,866 B2 3/2022 Yamada et al.
11,274,871 B2 3/2022 Sakae et al.
11,280,507 B2 3/2022 Yoneyama et al.
11,280,523 B2 3/2022 Sakae et al.
11,293,674 B2 4/2022 Yamada et al.
11,306,954 B2 4/2022 Arensmeier
11,346,570 B2 5/2022 Yoshimi
11,353,247 B2 6/2022 Bernhardt

(56) References Cited

U.S. PATENT DOCUMENTS 11,359,846 B2 6/2022 Welch
11,378,313 B2 7/2022 Goel
11,378,316 B2 7/2022 Walser
11,407,287 B2 8/2022 Repice
11,408,624 B2 8/2022 Hovardas
11,428,435 B2 8/2022 Eskew
11,435,102 B2 9/2022 Watanabe et al.
11,435,124 B2 9/2022 Kondrk
11,441,803 B2 9/2022 Goel
11,441,813 B2 9/2022 Tsuji
11,441,820 B2 9/2022 Weyna
11,472,265 B2 10/2022 Stockbridge
11,506,411 B2 11/2022 Shirai et al.
11,530,830 B2 12/2022 Watanabe et al.
11,536,502 B2 12/2022 Yajima
11,573,149 B2 2/2023 Gupte et al.
11,578,887 B2 2/2023 Delgoshaei
11,598,560 B2 3/2023 Yajima
11,604,019 B2 3/2023 Alfano
11,604,156 B2 3/2023 Chen et al.
11,609,009 B2 3/2023 Blanton
11,609,031 B2 3/2023 Matsuda et al.
11,609,032 B2 3/2023 Butler
11,609,046 B2 3/2023 Thobias
11,614,249 B2 3/2023 Chen et al.
11,635,339 B2 4/2023 Willett
11,644,225 B2 5/2023 Delgoshaei
11,674,727 B2 6/2023 De
2002/0178738 A1 12/2002 Taira et al.
2004/0168505 A1 9/2004 Dudley
2006/0100513 A1 5/2006 Hashimoto
2008/0295580 A1 12/2008 Minor et al.
2009/0107157 A1 4/2009 Dube
2011/0112814 A1 5/2011 Clark
2013/0021159 A1 1/2013 Timm
2013/0061620 A1* 3/2013 Li ..... F25D 11/022 62/126
2013/0213068 A1 8/2013 Goel et al.
2014/0123685 A1 5/2014 Kim et al.
2015/0345813 A1* 12/2015 Rite ..... F24F 11/006
2016/0091241 A1 3/2016 Suzuki et al.
2016/0238268 A1 8/2016 Nishimura et al.
2016/0245566 A1 8/2016 Hiraki et al.
2016/0356668 A1 12/2016 Remes
2017/0122833 A1 5/2017 Furry
2017/0355246 A1 12/2017 Mathe et al.
2018/0087809 A1 3/2018 Ueda et al.
2018/0087815 A1 3/2018 Kujak et al.
2018/0094841 A1* 4/2018 Kester ..... F25B 41/34
2018/0119998 A1 5/2018 Suzuki et al.
2018/0183078 A1 6/2018 Yamada
2018/0183080 A1 6/2018 Yamada
2018/0259235 A1 9/2018 Delgoshaei
2018/0327179 A1 11/2018 Papas et al.
2018/0345364 A1 12/2018 Vukovic et al.
2019/0011325 A1 1/2019 Nanba et al.
2019/0020078 A1 1/2019 Brinkmann et al.
2019/0027345 A1 1/2019 Ishikawa et al.
2019/0133341 A1 5/2019 Fischer
2019/0170384 A1 6/2019 Mcquade et al.
2019/0170599 A1 6/2019 Kester
2019/0170600 A1 6/2019 Tice et al.
2019/0170603 A1 6/2019 Gupte et al.
2019/0195542 A1 6/2019 Hansen et al.
2019/0195550 A1 6/2019 Sakae et al.
2019/0204289 A1 7/2019 Wrobel
2019/0240289 A1 8/2019 Hohlbaum et al.
2019/0242602 A1 8/2019 Yamada et al.
2019/0264963 A1 8/2019 Kondrk
2019/0264965 A1* 8/2019 Tanaka ..... F25B 49/005
2019/0316820 A1 10/2019 Zhai et al.
2019/0316821 A1 10/2019 Zhai et al.
2019/0390877 A1 12/2019 Sakae et al.
2020/0011560 A1 1/2020 Minamida et al.
2020/0024544 A1 1/2020 Kaneko
2020/0033036 A1 1/2020 Yamada et al.
2020/0049361 A1 2/2020 Minamida et al.
2020/0056802 A1 2/2020 Suzuki et al.
2020/0110000 A1 4/2020 Roth
2020/0124493 A1 4/2020 Duerr
2020/0149792 A1 5/2020 Wang et al.
2020/0166470 A1 5/2020 Chen et al.
2020/0182734 A1 6/2020 Ueno et al.
2020/0200456 A1 6/2020 Fauser et al.
2020/0200564 A1 6/2020 Kikuchi et al.
2020/0208861 A1 7/2020 Chen et al.
2020/0232685 A1 7/2020 Swab
2020/0240869 A1 7/2020 Yesh et al.
2020/0261063 A1 8/2020 Ishida
2020/0263891 A1 8/2020 Noor et al.
2020/0271344 A1 8/2020 Ikeda et al.
2020/0300522 A1 9/2020 Inao
2020/0309434 A1 10/2020 Walser et al.
2020/0324624 A1 10/2020 Repice et al.
2020/0338958 A1 10/2020 Lundqvist
2020/0355420 A1 11/2020 Goel et al.
2020/0386431 A1 12/2020 Kondrk
2020/0386648 A1 12/2020 Luccini et al.
2020/0393140 A1 12/2020 Nouchi
2021/0001689 A1 1/2021 Kondrk et al.
2021/0018199 A1 1/2021 Blanton
2021/0018200 A1 1/2021 Watanabe et al.
2021/0071887 A1 3/2021 Jaber et al.
2021/0095876 A1 4/2021 Branson et al.
2021/0095887 A1 4/2021 Kilgo
2021/0108819 A1 4/2021 Chen et al.
2021/0108820 A1 4/2021 Hovardas et al.
2021/0108857 A1* 4/2021 Thobias ..... F24F 5/0035
2021/0123624 A1 4/2021 Kronstrom et al.
2021/0131696 A1 5/2021 She et al.
2021/0135255 A1 5/2021 Sawada et al.
2021/0140650 A1 5/2021 Wilson
2021/0140662 A1 5/2021 Goel et al.
2021/0148620 A1 5/2021 Yamada et al.
2021/0164678 A1 6/2021 Delgoshaei
2021/0180817 A1 6/2021 Brahme et al.
2021/0190353 A1 6/2021 Blanton
2021/0199359 A1 7/2021 Grabon
2021/0207830 A1 7/2021 Chen
2021/0207831 A1 7/2021 Lord
2021/0213802 A1 7/2021 Poolman et al.
2021/0215413 A1 7/2021 Deaville
2021/0229528 A1 7/2021 Stockbridge
2021/0247086 A1 8/2021 Sasaki
2021/0247096 A1 8/2021 Hovardas
2021/0268875 A1 9/2021 Weyna et al.
2021/0278128 A1 9/2021 Scarcella et al.
2021/0285680 A1 9/2021 Atchison et al.
2021/0285840 A1 9/2021 Willett
2021/0293430 A1 9/2021 Yamada
2021/0293431 A1 9/2021 Delgoshaei
2021/0293446 A1 9/2021 Fard
2021/0302056 A1 9/2021 Eskew et al.
2021/0310678 A1 10/2021 Weinert
2021/0325003 A1 10/2021 Weck et al.
2021/0348820 A1 11/2021 Kobayashi
2021/0356150 A1 11/2021 Green et al.
2021/0356154 A1 11/2021 Kobayashi
2021/0356155 A1 11/2021 Yoshimi et al.
2021/0364180 A1 11/2021 Chen
2021/0389028 A1 12/2021 Smith et al.
2021/0396413 A1 12/2021 Maddox
2021/0396696 A1 12/2021 Hornung
2021/0404685 A1 12/2021 Butler
2022/0003443 A1 1/2022 Kobayashi
2022/0003471 A1 1/2022 Welch
2022/0003472 A1 1/2022 Okuda
2022/0003627 A1 1/2022 Thyssen et al.
2022/0034568 A1 2/2022 Satou
2022/0042698 A1 2/2022 Butler
2022/0057100 A1 2/2022 Ikeda et al.
2022/0065506 A1 3/2022 Yajima
2022/0065832 A1 3/2022 Oggianu
2022/0082304 A1* 3/2022 Welch ..... F25B 13/00

(56) References Cited

U.S. PATENT DOCUMENTS

| | | | |
|---|---|---|---|
| 2022/0082323 | A1 | 3/2022 | Poulsen |
| 2022/0090979 | A1 | 3/2022 | Kester |
| 2022/0099346 | A1 | 3/2022 | Alfano |
| 2022/0128253 | A1 | 4/2022 | Suzuki |
| 2022/0128277 | A1 | 4/2022 | Fukuyama |
| 2022/0128278 | A1 | 4/2022 | Parker |
| 2022/0128281 | A1 | 4/2022 | Tsuji |
| 2022/0134844 | A1 | 5/2022 | Palmisano |
| 2022/0146132 | A1 | 5/2022 | McQuade |
| 2022/0170654 | A1 | 6/2022 | Delgoshaei |
| 2022/0186960 | A1 | 6/2022 | Hirai |
| 2022/0207436 | A1 | 6/2022 | Maruoka |
| 2022/0221184 | A1 | 7/2022 | Gupta |
| 2022/0243938 | A1 | 8/2022 | Notaro |
| 2022/0243939 | A1 | 8/2022 | Notaro |
| 2022/0243940 | A1 | 8/2022 | Notaro |
| 2022/0243941 | A1 | 8/2022 | Notaro |
| 2022/0252291 | A1 | 8/2022 | Alfano |
| 2022/0252304 | A1 | 8/2022 | Green |
| 2022/0268468 | A1 | 8/2022 | Green |
| 2022/0275983 | A1 | 9/2022 | Kawano et al. |
| 2022/0290885 | A1 | 9/2022 | Minami |
| 2022/0297510 | A1 | 9/2022 | Kondrk |
| 2022/0307711 | A1 | 9/2022 | Lord |
| 2022/0307740 | A1 | 9/2022 | Lord |
| 2022/0307937 | A1 | 9/2022 | Thyssen |
| 2022/0341612 | A1 | 10/2022 | West |
| 2022/0341804 | A1 | 10/2022 | West |
| 2022/0349600 | A1 | 11/2022 | Alfano |
| 2022/0397297 | A1 | 12/2022 | Foster |
| 2022/0412591 | A1 | 12/2022 | Kokes |
| 2022/0412625 | A1 | 12/2022 | Grabon |
| 2023/0003604 | A1 | 1/2023 | West |
| 2023/0009291 | A1 | 1/2023 | Hjortland |
| 2023/0013427 | A1 | 1/2023 | Branson |
| 2023/0020905 | A1 | 1/2023 | Xiong |
| 2023/0032795 | A1 | 2/2023 | Sunderland |
| 2023/0048352 | A1 | 2/2023 | Wright |
| 2023/0052745 | A1 | 2/2023 | Kitagawa |
| 2023/0058790 | A1 | 2/2023 | Rumler |
| 2023/0074091 | A1 | 3/2023 | Shaw |
| 2023/0085125 | A1 | 3/2023 | Yamaguchi |
| 2023/0088662 | A1 | 3/2023 | Atchison |
| 2023/0090958 | A1 | 3/2023 | Atchison |
| 2023/0094980 | A1 | 3/2023 | Birnkrant |
| 2023/0106462 | A1 | 4/2023 | Hovardas |
| 2023/0107694 | A1 | 4/2023 | Kawano |
| 2023/0109334 | A1 | 4/2023 | Welch |
| 2023/0117306 | A1 | 4/2023 | Petele |

FOREIGN PATENT DOCUMENTS

| | | | | |
|---|---|---|---|---|
| CN | 204043134 | U | 12/2014 | |
| CN | 109073262 | A | 12/2018 | |
| CN | 110375466 | A | 10/2019 | |
| CN | 110375467 | A | 10/2019 | |
| CN | 110646362 | A | 1/2020 | |
| DE | 102017217685 | A1 | 1/2019 | |
| DE | 102019205908 | A1 | 10/2020 | |
| EP | 0148591 | A1 | 7/1985 | |
| EP | 0 783 099 | A1 | 7/1997 | |
| EP | 1792571 | A1 | 6/2007 | |
| EP | 2 354 724 | A2 | 8/2011 | |
| EP | 3040654 | A1 | 7/2016 | |
| EP | 3054231 | A1 | 8/2016 | |
| EP | 3 279 580 | A1 | 2/2018 | |
| EP | 3 321 607 | A1 | 5/2018 | |
| EP | 3 425 295 | A1 | 1/2019 | |
| EP | 3428554 | A1 | 1/2019 | |
| EP | 3 457 044 | A1 | 3/2019 | |
| EP | 3 460 347 | A1 | 3/2019 | |
| EP | 3534084 | A1 | 9/2019 | |
| EP | 3584522 | A1 | 12/2019 | |
| EP | 3405629 | A4 | 1/2020 | |
| EP | 3 683 518 | A1 | 7/2020 | |
| EP | 3 686 520 | A1 | 7/2020 | |
| EP | 3 374 701 | B1 | 9/2020 | |
| EP | 3693687 | A3 | 10/2020 | |
| EP | 3730854 | A1 | 10/2020 | |
| EP | 3751209 | A1 | 12/2020 | |
| EP | 3757278 | A1 | 12/2020 | |
| EP | 3798527 | A1 | 3/2021 | |
| EP | 3816542 | A1 | 5/2021 | |
| EP | 3819564 | A1 * | 5/2021 | |
| EP | 3859223 | A1 | 8/2021 | |
| EP | 3859249 | A1 | 8/2021 | |
| EP | 3875861 | A1 | 9/2021 | |
| EP | 3901526 | A1 | 10/2021 | |
| EP | 3901530 | A1 | 10/2021 | |
| EP | 3906382 | A1 | 11/2021 | |
| EP | 3911931 | A2 | 11/2021 | |
| EP | 3919837 | A1 | 12/2021 | |
| EP | 3 943 858 | A1 | 1/2022 | |
| EP | 3 961 119 | A1 | 3/2022 | |
| EP | 3 974 032 | A1 | 3/2022 | |
| EP | 4 033 165 | A1 | 7/2022 | |
| EP | 3 869 122 | B1 | 11/2022 | |
| EP | 4 160 101 | A1 | 4/2023 | |
| ES | 2804267 | T3 | 2/2021 | |
| FR | 3 102 237 | A1 | 4/2021 | |
| FR | 3111418 | A1 | 12/2021 | |
| GB | 2566201 | A | 3/2019 | |
| JP | 2000-249435 | A | 9/2000 | |
| JP | P2002-92714 | A | 3/2002 | |
| JP | 2002-206984 | A | 7/2002 | |
| JP | P2002-263445 | A | 9/2002 | |
| JP | 2003-161551 | A | 6/2003 | |
| JP | 2006-158411 | A | 6/2006 | |
| JP | P2007-127316 | A | 5/2007 | |
| JP | 2008-064453 | A | 3/2008 | |
| JP | P2010-210129 | A | 9/2010 | |
| JP | 2014-035171 | A | 2/2014 | |
| JP | 5971371 | B1 * | 8/2016 | ..... F25B 13/00 |
| JP | 2018-167861 | A | 11/2018 | |
| JP | 2019-016959 | A | 1/2019 | |
| JP | 6466219 | B2 | 2/2019 | |
| JP | 6528446 | B2 | 6/2019 | |
| JP | 6557329 | B2 | 8/2019 | |
| JP | 6628833 | B2 | 1/2020 | |
| JP | 6656363 | B2 | 3/2020 | |
| JP | 2020-515850 | A | 5/2020 | |
| JP | 6701337 | B2 | 5/2020 | |
| JP | 2020-130326 | A | 8/2020 | |
| JP | 2020-169798 | A | 10/2020 | |
| JP | 6766638 | B2 | 10/2020 | |
| JP | 6766639 | B2 | 10/2020 | |
| JP | 2020-183829 | A | 11/2020 | |
| JP | 6779355 | B2 | 11/2020 | |
| JP | 2020-194490 | A | 12/2020 | |
| JP | 2021-075076 | A | 5/2021 | |
| JP | 2021-131182 | A | 9/2021 | |
| JP | 2021-131194 | A | 9/2021 | |
| JP | 2021-131200 | A | 9/2021 | |
| JP | 6931093 | B2 | 9/2021 | |
| KR | 10-2014-0100341 | A | 8/2014 | |
| KR | 10-1609677 | B1 | 4/2016 | |
| KR | 10-2016-0066367 | A | 6/2016 | |
| KR | 10-2019-0009713 | A | 1/2019 | |
| KR | 10-2019-0058448 | A | 5/2019 | |
| KR | 10-2021-0001769 | A | 1/2021 | |
| KR | 10-2021-0042970 | A | 4/2021 | |
| MX | 2019011319 | A | 11/2019 | |
| RU | 2720037 | C2 | 4/2020 | |
| WO | 2010/007448 | A1 | 1/2010 | |
| WO | 2014/160831 | A1 | 10/2014 | |
| WO | WO-2015159625 | A1 * | 10/2015 | ..... B60H 1/00392 |
| WO | WO-2016004390 | A2 * | 1/2016 | ..... F25B 1/005 |
| WO | 2017/002215 | A1 | 1/2017 | |
| WO | 2017/127802 | A1 | 7/2017 | |
| WO | 2017/195336 | A1 | 11/2017 | |
| WO | WO-2017216861 | A1 * | 12/2017 | ..... F24F 11/84 |
| WO | 2018/167861 | A1 | 9/2018 | |
| WO | 2019/225031 | A1 | 11/2019 | |
| WO | 2020/010082 | A1 | 1/2020 | |

(56) References Cited

FOREIGN PATENT DOCUMENTS

| | | | | | |
|---|---|---|---|---|---|
| WO | WO-2020250889 | A1 * | 12/2020 | ..... | F24F 11/36 |
| WO | 2021/260588 | A1 | 12/2021 | | |
| WO | 2022/244177 | A1 | 11/2022 | | |
| WO | 2022/264368 | A1 | 12/2022 | | |

OTHER PUBLICATIONS

WO-2017216861-A1 English Translation (Year: 2017).*
WO-2015159625-A1 English Translation (Year: 2015).*
WO-2020250889-A1 English Translation (Year: 2020).*
JP-5971371-B1 English Translation (Year: 2016).*

* cited by examiner

REFRIGERANT LEAK MITIGATION SYSTEM

TECHNOLOGICAL FIELD

The present disclosure relates generally to an improved device and method for mitigating the risk associated with refrigerant leaks from heating, ventilation, and air conditioning (HVAC) systems.

BACKGROUND

Heating, ventilation, and air conditioning (HVAC) systems typically rely on refrigerant to transport heat across a temperature gradient. This process involves complex thermodynamics where the refrigerant often goes through various phase changes. In addition, the boiling temperature of the refrigerant at various pressures changes and is often controlled to allow the heat to move across the temperature gradient. As a result, there are only a limited number of chemical compounds that may function appropriately as a refrigerant in an HVAC system.

In recent years, HVAC systems have begun to move to more organic refrigerants, which are beneficial to the global environment. These newer refrigerants, however, are often flammable. Thus, these refrigerants may increase the risk of fire, relative to previously used refrigerants, if leaked outside of the refrigerant circuit within an HVAC system.

One option to account for the increased fire risk is the implementation of refrigerant leak detectors. These leak detectors, however, increase costs. In some instances, it is expected that multiple detectors may be needed to account for the various potential orientations in which a device may be installed. Moreover, these configurations are limited to addressing and reducing the risk of the leak after it has begun. This can lead to excessive amounts of refrigerant being present outside the refrigerant circuit by the time the leak is detected and/or mitigation processes take place.

As a result, there exists a need to control the refrigerant within the HVAC system to limit the impact of any refrigerant leak prior to the leak being detected. This may be particularly important at the most sensitive locations such as inside a building or structure.

BRIEF SUMMARY

The present disclosure addresses the deficiencies described above and provides a system for controlling the mass of refrigerant within an indoor unit to reduce harmful effects that may be caused as the result of a leak. As part of this process, the device and method disclosed herein utilize at least one mass control valve to control the mass of refrigerant within the HVAC system, potentially an indoor unit. The device and method disclosed herein may control the mass control valve to ensure that refrigerant entering the indoor unit is utilized by the system. The device and method may further close the mass control valve upon various events or sensed conditions to ensure the mass of refrigerant is consistently maintained below a given threshold value.

The present disclosure thus includes, without limitation, the following example embodiments.

Some example implementations provide a heating, ventilation and air conditioning (HVAC) system operable to mitigate refrigerant leaks before they are detected, comprising: an indoor unit including an indoor fan and an indoor heat exchanger; an outdoor unit including an outdoor heat exchanger and a compressor; a refrigerant circuit including a refrigerant circulated between the indoor unit and the outdoor unit; a mass control valve coupled to the refrigerant circuit; and control circuitry configured to: operate the HVAC system to satisfy a conditioning load by circuiting the refrigerant through the refrigerant circuit and operating the indoor fan; and close the mass control valve to at least partially isolate the refrigerant circuit at the indoor heat exchanger in response to the indoor fan being shut off.

In some example implementations of the HVAC system of any example implementation, or any combination of any preceding example implementation, the control circuitry is not coupled to a device for sensing refrigerant leaks.

In some example implementations of the HVAC system of any example implementation, or any combination of any preceding example implementation, the indoor unit comprises an indoor metering device configured to adjust a refrigerant flow based on the conditioning load, wherein the mass control valve is the indoor metering device, and wherein the compressor comprises a check valve fluidly coupled with an inlet of a compressor.

In some example implementations of the HVAC system of any example implementation, or any combination of any preceding example implementation, the control circuitry is further configured to override any commands to the indoor metering device based on the conditioning load and completely close the indoor metering device in response to the indoor fan being shut off.

In some example implementations of the HVAC system of any example implementation, or any combination of any preceding example implementation, the mass control valve is a normally closed solenoid valve, and the indoor fan and the mass control valve are electrically connected in series such that the indoor fan and the mass control valve are energized and deenergized jointly.

In some example implementations of the HVAC system of any example implementation, or any combination of any preceding example implementation, the mass control valve comprises a first mass control valve located at a refrigerant inlet to the indoor unit and spaced apart from an indoor metering device, and the HVAC system further comprises a second mass control valve located at a refrigerant outlet from the indoor unit and spaced apart from the indoor metering device, and the control circuitry is further configured to control a mass of refrigerant in the indoor unit by modulating at least one of the first or the second mass control valves.

In some example implementations of the HVAC system of any example implementation, or any combination of any preceding example implementation, the HVAC system further includes a pressure sensor configured to measure a pressure of the refrigerant within the refrigeration circuit, and a temperature sensor configured to measure a temperature of the refrigerant within the refrigeration circuit, wherein the pressure and temperature sensors are coupled to the control circuitry, and the control circuitry is further configured to control the mass of refrigerant in the indoor unit by modulating the at least one of the first or second mass control valves based on measurements received from one of the pressure sensor or the temperature sensor.

Some example implementations provide a heating, ventilation and air conditioning (HVAC) system operable to mitigate refrigerant leaks before they are detected, comprising: an indoor unit including an indoor fan and an indoor heat exchanger; a furnace coupled to the indoor unit; an outdoor unit including an outdoor heat exchanger and a compressor; a refrigerant circuit including a refrigerant circulated between the indoor unit and the outdoor unit; a mass control valve coupled to the refrigerant circuit; and control circuitry configured to: operate the HVAC system to satisfy a cooling conditioning load by circuiting the refrigerant through the refrigerant circuit and operating the indoor fan; and close the mass control valve to at least partially isolate the refrigerant circuit at the indoor heat exchanger in response to the indoor fan being shut off.

In some example implementations of the HVAC system of any example implementation, or any combination of any preceding example implementation, the control circuitry is not coupled to a device for sensing refrigerant leaks.

In some example implementations of the HVAC system of any example implementation, or any combination of any preceding example implementation, the furnace is a gas-fired furnace.

In some example implementations of the HVAC system of any example implementation, or any combination of any preceding example implementation, the mass control valve comprises a first mass control valve located at a refrigerant inlet to the indoor unit and spaced apart from an indoor metering device, and the HVAC system further comprises a second mass control valve located at a refrigerant outlet from the indoor unit and spaced apart from the indoor metering device, and the control circuitry is further configured to control a mass of refrigerant in the indoor unit by modulating at least one of the first mass control valve or the second mass control valve.

Some example implementations provide a method of mitigating the impact of refrigerant leaks prior to leaks being detected, the method comprising: circulating a refrigerant in a refrigerant circuit between an indoor unit that includes an indoor fan and an indoor heat exchanger and an outdoor unit that includes an outdoor heat exchanger and a compressor to satisfy a conditioning load; operating the indoor fan in response to the conditioning load; and closing a mass control valve to at least partially isolate the indoor heat exchanger in response to the indoor fan being shut off.

In some example implementations of the method of any example implementation, or any combination of any preceding example implementation, the method further includes controlling a mass of refrigerant in the indoor unit to maintain less than a given mass threshold value of refrigerant in the indoor unit.

In some example implementations of the method of any example implementation, or any combination of any preceding example implementation, the given mass threshold value is approximately 4 pounds.

In some example implementations of the method of any example implementation, or any combination of any preceding example implementation, the method further includes controlling the mass of refrigerant in the indoor unit by modulating the mass control valve based on measurements received from one of a pressure or a temperature sensor.

In some example implementations of the method of any example implementation, or any combination of any preceding example implementation, wherein the mass control valve is a first mass control valve, and the method further includes controlling a mass of refrigerant in the indoor unit by modulating the first mass control valve at a refrigerant inlet to the indoor unit and modulating a second mass control valve at a refrigerant outlet from the indoor unit.

In some example implementations of the method of any example implementation, or any combination of any preceding example implementation, the method further includes monitoring a first flow rate of refrigerant into the indoor unit and a second flow rate of refrigerant out of the indoor unit; and controlling the mass of refrigerant by modulating the mass control valve to reduce the first flow rate of refrigerant into the indoor unit in response to the first flow rate being greater than the second flow rate.

In some example implementations of the method of any example implementation, or any combination of any preceding example implementation, the method further includes reducing the first flow rate occurs when the first flow rate is greater than the second flow rate for one of a given period of time or by a certain amount.

In some example implementations of the method of any example implementation, or any combination of any preceding example implementation, the method further includes providing an alert when the first flow rate is greater than the second flow rate for a threshold period of time.

In some example implementations of the method of any example implementation, or any combination of any preceding example implementation, the method further includes opening an indoor metering device in response to the closing of the mass control valve.

These and other features, aspects, and advantages of the disclosure will be apparent from a reading of the following detailed description together with the accompanying drawings, which are briefly described below. The disclosure includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed disclosure, in any of its various aspects and embodiments, should be viewed as intended to be combinable unless the context clearly dictates otherwise.

BRIEF DESCRIPTION OF THE FIGURE(S)

In order to assist the understanding of aspects of the disclosure, reference will now be made to the appended drawings, which are not necessarily drawn to scale. The drawings are provided by way of example to assist in the understanding of aspects of the disclosure, and should not be construed as limiting the disclosure.

Figure 3A:
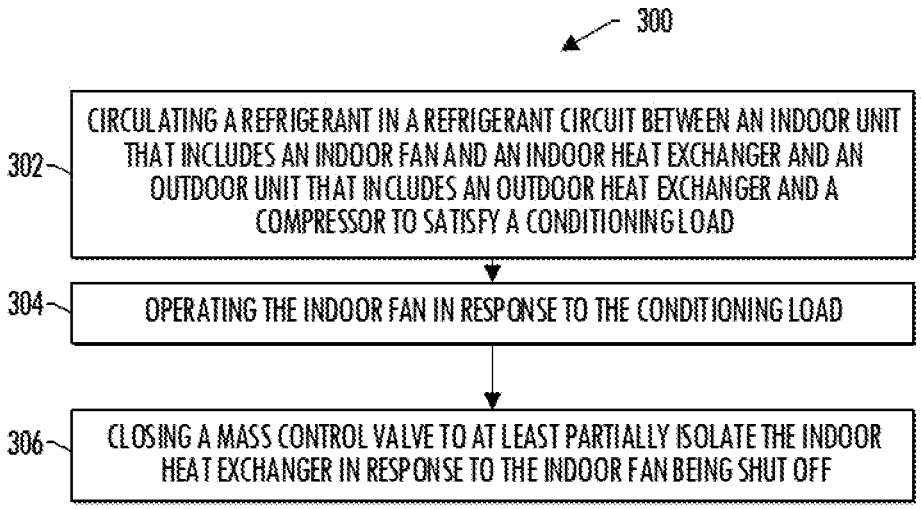
Figure 3B:
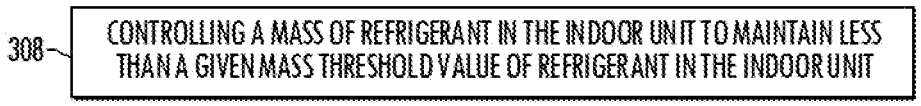
Figure 3C:
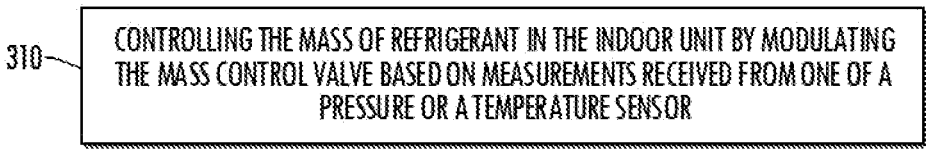
Figure 3D:
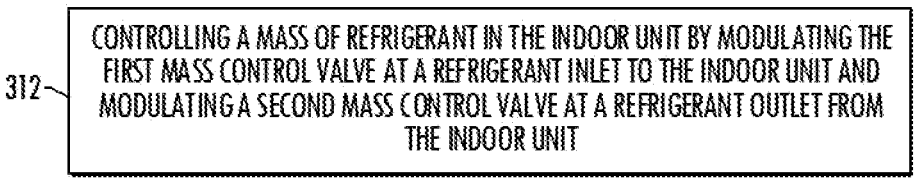
Figure 3E:
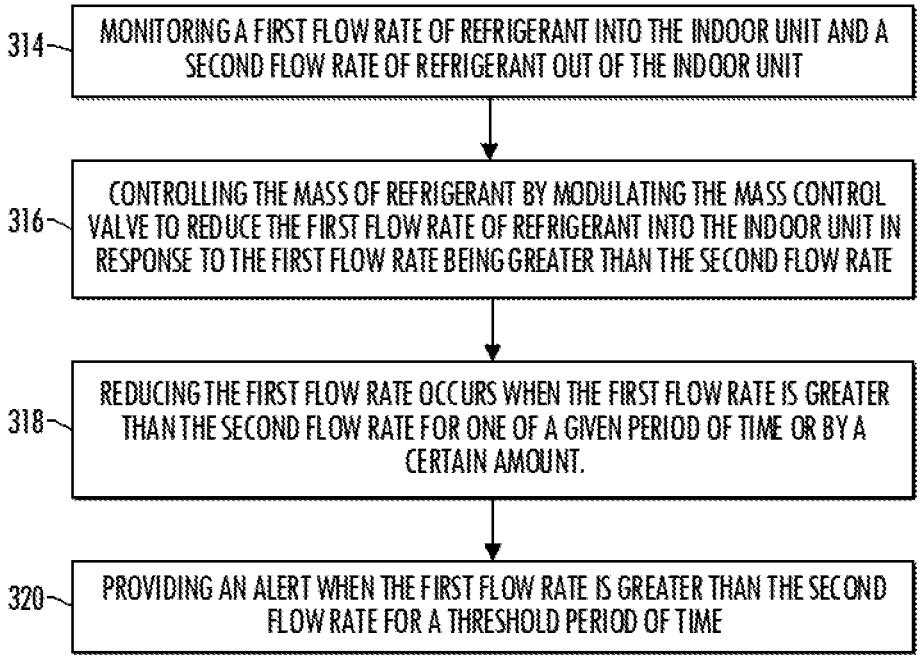
Figure 3F:
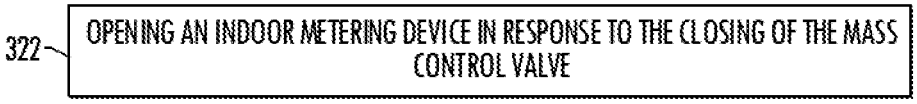
Figure 4:
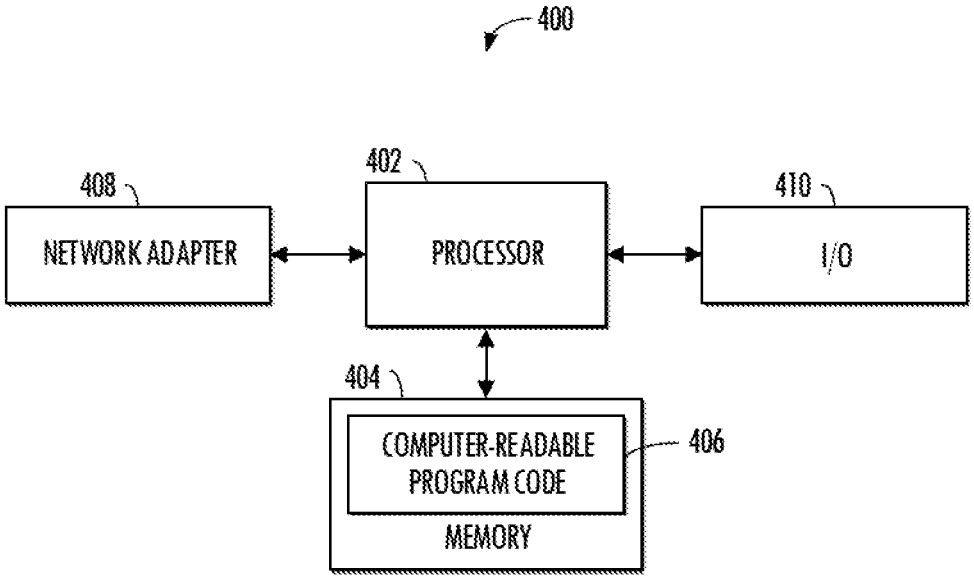

FIGS. 3A, 3B, 3C, 3D, 3E, and 3F are flowcharts illustrating various operations in a method of mitigating refrigerant leaks, according to some example embodiments; and FIG. 4 is an illustration of control circuitry, according to an example embodiment of the present disclosure.

DETAILED DESCRIPTION

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art.

For example, unless specified otherwise or clear from context, references to first, second or the like should not be construed to imply a particular order. A feature described as being above another feature (unless specified otherwise or clear from context) may instead be below, and vice versa; and similarly, features described as being to the left of another feature may instead be to the right, and vice versa. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise, or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Like reference numerals refer to like elements throughout.

As used herein, the terms "bottom," "top," "upper," "lower," "upward," "downward," "rightward," "leftward," "interior," "exterior," and/or similar terms are used for ease of explanation and refer generally to the position of certain components or portions of the components of embodiments of the described disclosure in the installed configuration (e.g., in an operational configuration). It is understood that such terms are not used in any absolute sense.

Example embodiments of the present disclosure relate generally to an improved HVAC system designed to mitigate the risk of refrigerant leaks prior to the leaks being detected, as well as methods for controlling HVAC systems for the same purpose. The disclosed HVAC system may include an indoor unit with an indoor unit fan, an outdoor unit, a refrigerant circuit that circulates a refrigerant between the indoor and outdoor unit, at least one mass control valve that controls the mass of refrigerant present in the indoor unit, control circuitry, and in some embodiments, a furnace. The control circuitry may use the mass control valve to control the mass of refrigerant in the indoor unit. The control circuitry may also operate the indoor fan in response to a conditioning load, and the control circuitry may further close the mass control valve to terminate the supply of refrigerant in response to the indoor fan being shut off.

In some embodiments, as described more fully herein, controlling the mass control valve based on operation of the indoor fan may allow the system to maintain a limited mass of refrigerant within the indoor unit. The control circuitry may further be configured to override any conditioning control mechanism, which often dictates refrigerant flow, thus ensuring that the mass of refrigerant in the indoor unit is maintained at a sufficiently low level. In some embodiments, the mass control valve is controlled in additional ways to regulate the flow of refrigerant into (and out of) the indoor unit. Example embodiments are described more fully below along with example components and features that may be included.

Figure 1A:
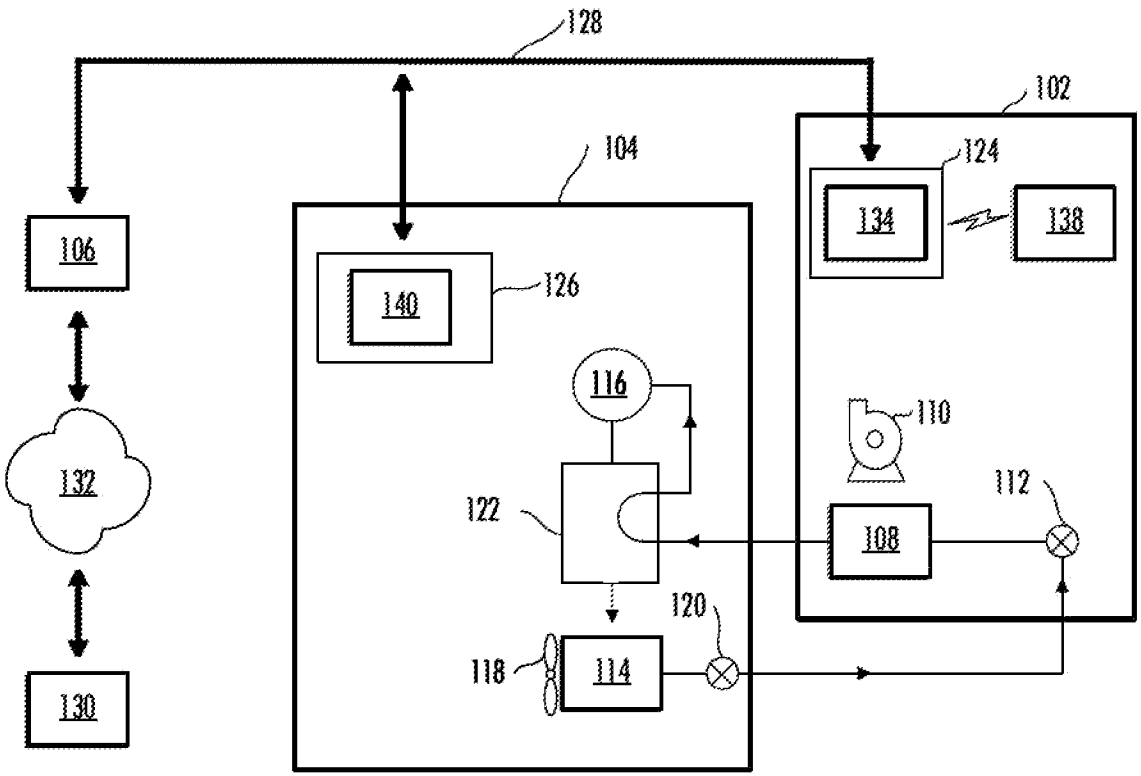
FIG. 1A is a schematic of an HVAC system, according to an example embodiment of the present disclosure.
Figure 1B:
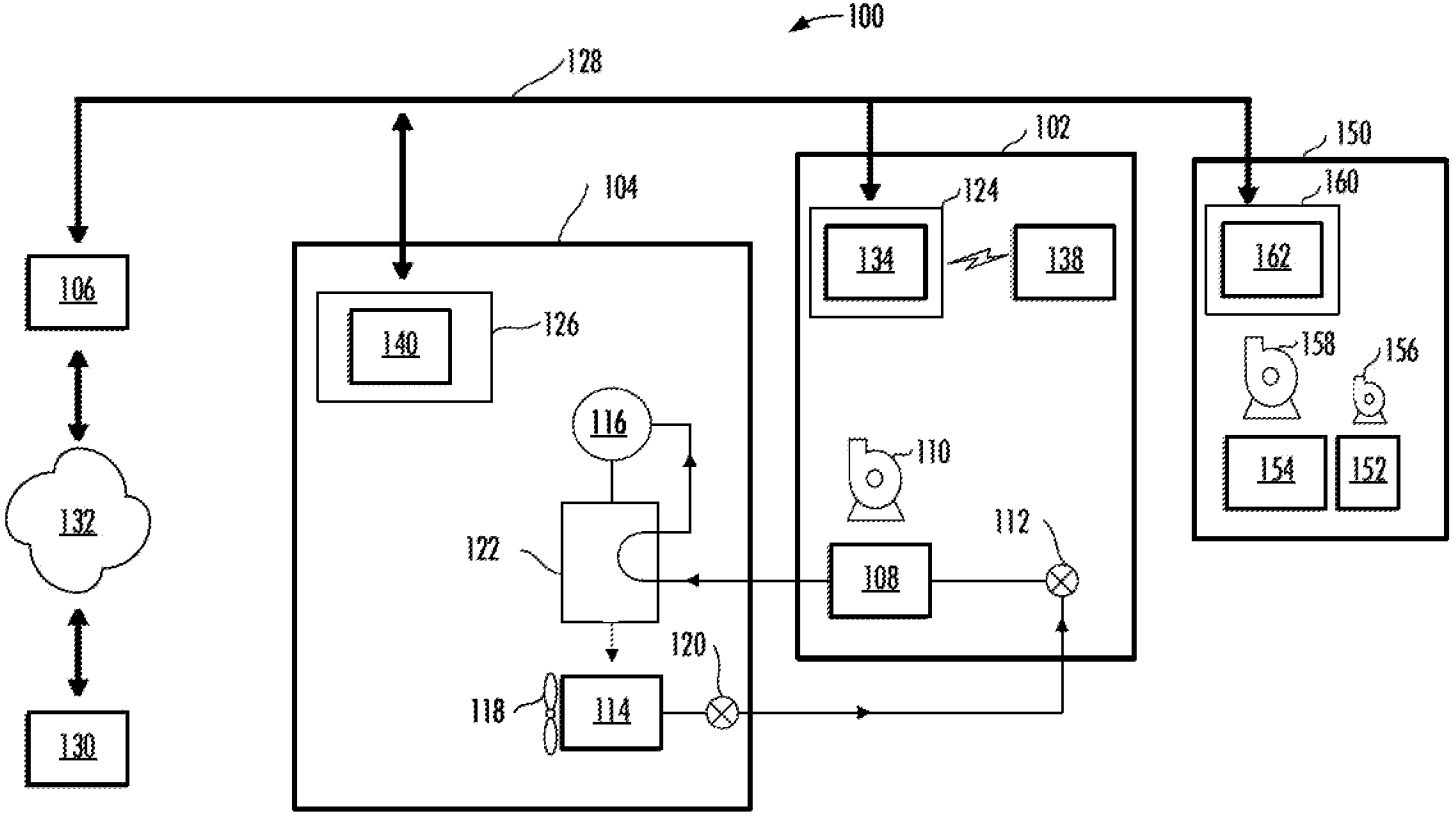
FIG. 1B is another schematic of an HVAC system, according to an example embodiment of the present disclosure.

FIGS. 1A and 1B show schematic diagrams of a typical HVAC system 100. In some embodiments, the HVAC system 100 comprises a heat pump system that may be selectively operated to implement one or more substantially closed thermodynamic refrigerant cycles to provide a cooling functionality (hereinafter a "cooling mode") and/or a heating functionality (hereinafter a "heating mode"). The embodiments depicted in FIGS. 1A and 1B are configured in a cooling mode. The HVAC system 100, in some embodiment is configured as a split system heat pump system, and generally comprises an indoor unit 102, an outdoor unit 104, and a system controller 106 that may generally control operation of the indoor unit 102 and/or the outdoor unit 104. The depicted embodiment shown in FIG. 1B includes a furnace 150. The furnace 150 may be used in some embodiments to provide heat to the conditioned air, and in some embodiments, when a furnace is included the refrigerant only cycles in a cooling mode and the furnace is used to satisfy the heating load.

Indoor unit 102 generally comprises an indoor air handling unit comprising an indoor heat exchanger 108, an indoor fan 110, an indoor metering device 112, and an indoor controller 124. The indoor heat exchanger 108 may generally be configured to promote heat exchange between a refrigerant carried within internal tubing of the indoor heat exchanger 108 and an airflow that may contact the indoor heat exchanger 108 but that is segregated from the refrigerant.

The indoor metering device 112 may generally comprise an electronically-controlled motor-driven electronic expansion valve (EEV). In some embodiments, however, the indoor metering device 112 may comprise a thermostatic expansion valve, a capillary tube assembly, and/or any other suitable metering device.

Outdoor unit 104 generally comprises an outdoor heat exchanger 114, a compressor 116, an outdoor fan 118, an outdoor metering device 120, a switch over valve 122, and an outdoor controller 126. The outdoor heat exchanger 114 may generally be configured to promote heat transfer between a refrigerant carried within internal passages of the outdoor heat exchanger 114 and an airflow that contacts the outdoor heat exchanger 114 but is segregated from the refrigerant.

The outdoor metering device 120 may generally comprise a thermostatic expansion valve. In some embodiments, however, the outdoor metering device 120 may comprise an electronically-controlled motor driven EEV similar to indoor metering device 112, a capillary tube assembly, and/or any other suitable metering device.

In some embodiments, the switch over valve 122 may generally comprise a four-way reversing valve. The switch over valve 122 may also comprise an electrical solenoid, relay, and/or other device configured to selectively move a component of the switch over valve 122 between operational positions to alter the flow path of refrigerant through the switch over valve 122 and consequently the HVAC system 100. Additionally, the switch over valve 122 may also be selectively controlled by the system controller 106, an outdoor controller 126, and/or the indoor controller 124.

The embodiment depicted in FIG. 1B, also includes a furnace 150, which may be used in some implementations of the HVAC system 100. The furnace may be used in the HVAC system to satisfy a heating load, and in some embodiments, a furnace is used when a traditional, cooling mode only, air conditioning unit is used as opposed to a heat pump.

Any conventional furnace may be used with the disclosure herein. In the depicted embodiment, furnace 150 is a gas-fired furnace. In this embodiment, furnace 150 includes a burner assembly 152, a heat exchanger assembly 154, a combustion air blower 156, a circulation air blower 158, and a furnace controller 160. These components are used to supply heat to the conditioned air. For example, the gas-fired furnace 150 may generate heat by combusting gas at the burner assembly 152. This gas is supplied to the furnace through a gas supply line (not shown) and mixed with air to facilitate combustion at the burner assembly 152. The combustion air blower 156 moves the combustion air into the burner assembly 152 for combustion, and after combustion occurs, the combustion air blower 156 continues to move the combustion by-products (including heat) through the heat exchanger 154. The circulating air blower 158 moves the circulating air through the heat exchanger 154 allowing the circulating air to increase in temperature to satisfy a heating load.

In some embodiments, the furnace 150 is coupled to and/or integrated with the indoor unit 102. In these embodiments, the furnace may utilize some of the features associated with the indoor unit. For example, the indoor fan 110 may serve as circulation air blower 158 for the furnace 150. In addition, the indoor controller 124 may serve as the furnace controller 160. Other configurations or types of furnaces, including electric heat elements, may be used.

The system controller 106 may generally be configured to selectively communicate with the indoor controller 124 of the indoor unit 102, the outdoor controller 126 of the outdoor unit 104, the furnace controller 160 and/or other components of the HVAC system 100. In some embodiments, the system controller 106 may be configured to control operation of the indoor unit 102, the outdoor unit 104, and/or the furnace 150. In some embodiments, the system controller 106 may be configured to monitor and/or communicate with a plurality of temperature sensors associated with components of the indoor unit 102, the outdoor unit 104, the furnace 150, and/or the outdoor ambient temperature. Additionally, in some embodiments, the system controller 106 may comprise a temperature sensor and/or may further be configured to control heating and/or cooling of conditioned spaces or zones associated with the HVAC system 100. In other embodiments, the system controller 106 may be configured as a thermostat for controlling the supply of conditioned air to zones associated with the HVAC system 100, and in some embodiments, the thermostat includes a temperature sensor.

The system controller 106 may also generally comprise an input/output (I/O) unit (e.g., a graphical user interface, a touchscreen interface, or the like) for displaying information and for receiving user inputs. The system controller 106 may display information related to the operation of the HVAC system 100 and may receive user inputs related to operation of the HVAC system 100. However, the system controller 106 may further be operable to display information and receive user inputs tangentially related and/or unrelated to operation of the HVAC system 100. In some embodiments, the system controller 106 may not comprise a display and may derive all information from inputs that come from remote sensors and remote configuration tools.

In some embodiments, the system controller 106 may be configured for selective bidirectional communication over a communication bus 128, which may utilize any type of communication network (e.g., a controller area network (CAN) messaging, etc.). In some embodiments, portions of the communication bus 128 may comprise a three-wire connection suitable for communicating messages between the system controller 106 and one or more of the components of the HVAC system 100 configured for interfacing with the communication bus 128. Still further, the system controller 106 may be configured to selectively communicate with components of the HVAC system 100 and/or any other device 130 via a communication network 132. In some embodiments, the communication network 132 may comprise a telephone network, and the other device 130 may comprise a telephone. In some embodiments, the communication network 132 may comprise the Internet, and the other device 130 may comprise a smartphone and/or other Internet-enabled mobile telecommunication device.

The indoor controller 124 may be carried by the indoor unit 102 and may generally be configured to receive information inputs, transmit information outputs, and/or otherwise communicate with the system controller 106, the outdoor controller 126, and/or any other device 130 via the communication bus 128 and/or any other suitable medium of communication. In some embodiments, the indoor controller 124 may be configured to communicate with an indoor personality module 134 that may comprise information related to the identification and/or operation of the indoor unit 102.

The indoor EEV controller 138 may be configured to receive information regarding temperatures and/or pressures of the refrigerant in the indoor unit 102. More specifically, the indoor EEV controller 138 may be configured to receive information regarding temperatures and pressures of refrigerant entering, exiting, and/or within the indoor heat exchanger 108.

The outdoor controller 126 may be carried by the outdoor unit 104 and may be configured to receive information inputs, transmit information outputs, and/or otherwise communicate with the system controller 106, the indoor controller 124, and/or any other device 130 via the communication bus 128 and/or any other suitable medium of communication. In some embodiments, the outdoor controller 126 may be configured to communicate with an outdoor personality module 140 that may comprise information related to the identification and/or operation of the outdoor unit 104. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116.

Figure 2A:
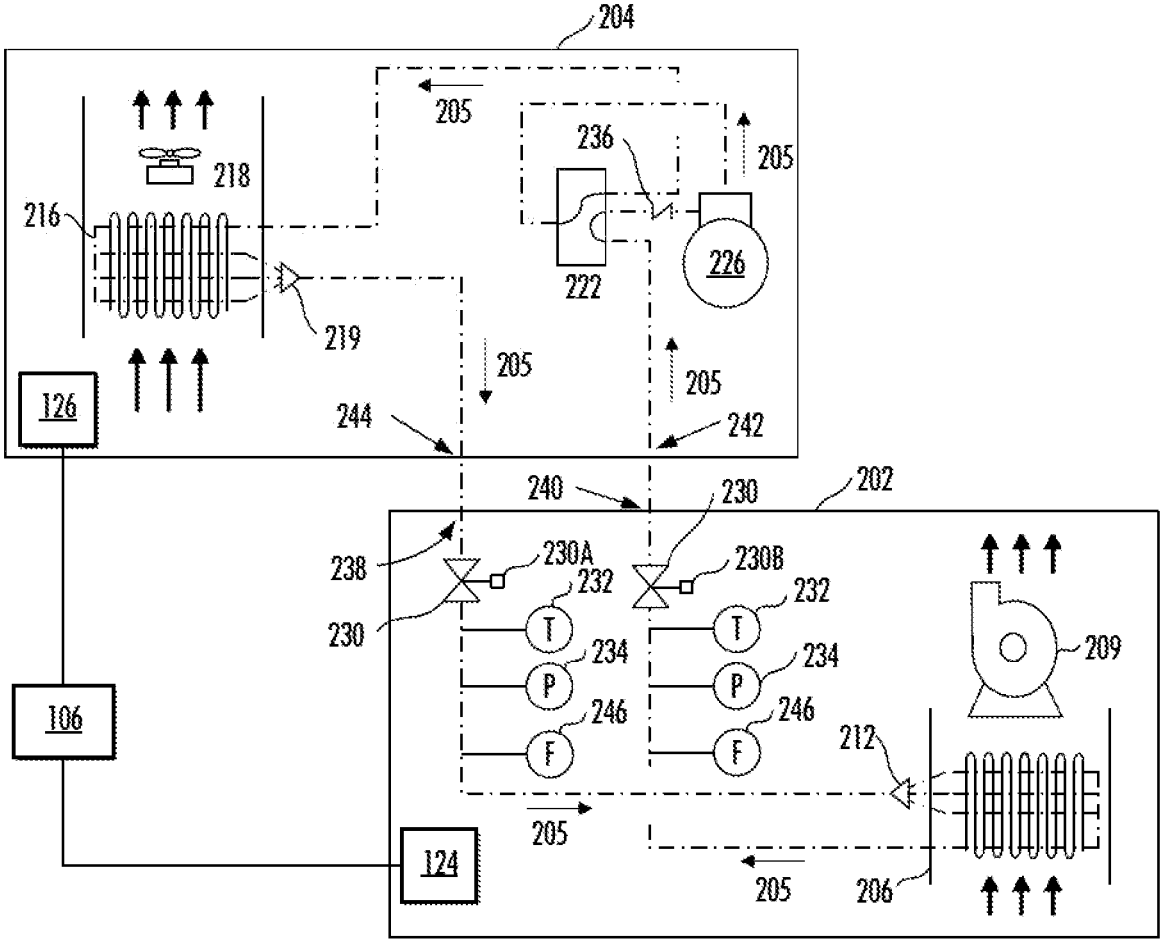
FIG. 2A is a schematic of a cooling mode refrigerant cycle of an HVAC system, according to an example embodiment of the present disclosure.
Figure 2B:
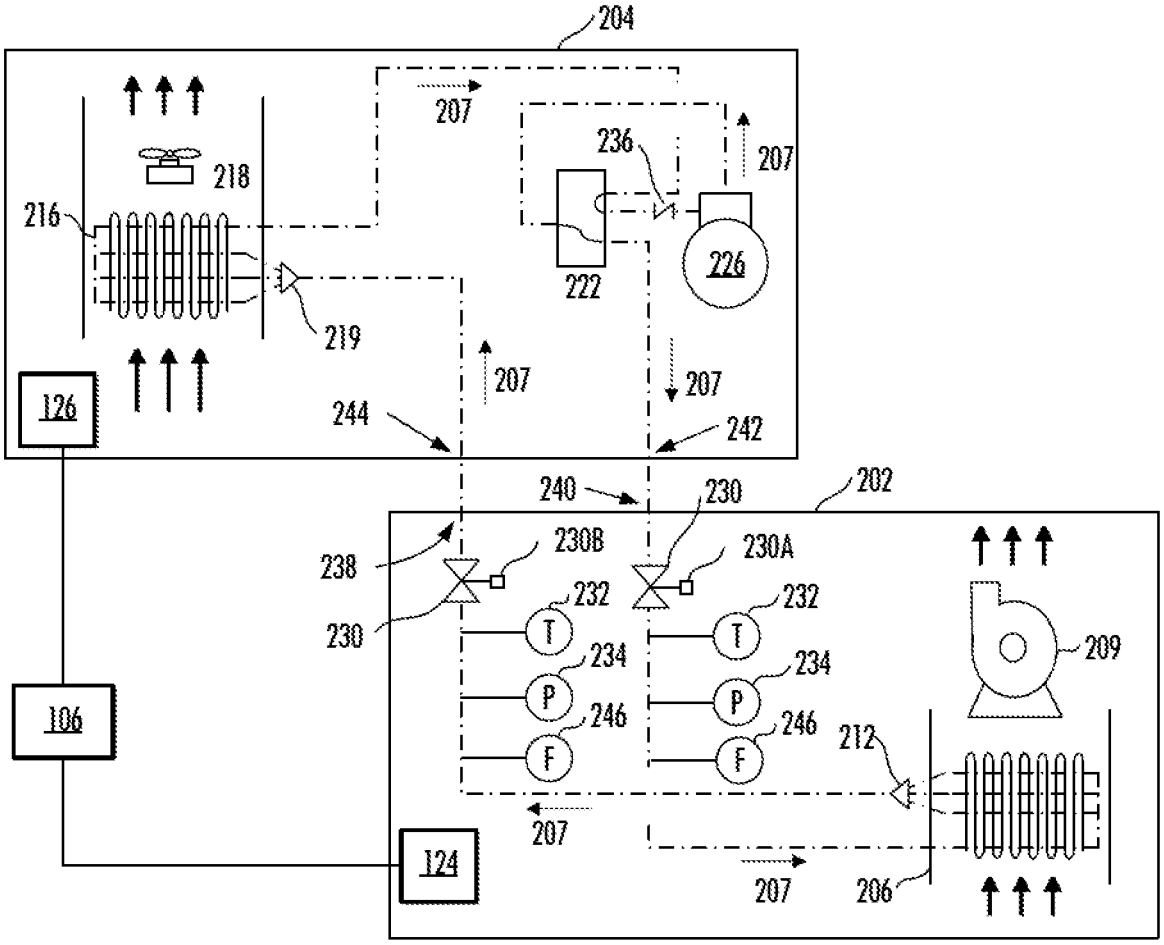
FIG. 2B is a schematic of a heating mode refrigerant cycle of an HVAC system, according to an example embodiment of the present disclosure.

As discussed above, the HVAC system 100 may operate in at least two operating modes—a heating mode and a cooling mode. FIGS. 2A and 2B provide a more detailed illustration of these components and others that may be utilized with the embodiments disclosed herein, where these components are shown in the cooling mode (FIG. 2A) and the heating mode (FIG. 2B), respectively. As discussed below, the refrigerant may go through various phase changes in these cycles. For example, in some embodiments the refrigerant changes between a liquid, a mixed fluid comprising a liquid and a gas, and a gas.

Turning to FIG. 2A, an example schematic of a cooling mode is shown. In the depicted embodiment, the direction the refrigerant travels in this refrigerant circuit is indicated by arrows 205. Starting at the compressor 226 in FIG. 2A, compressor 226 may compress the refrigerant and pump a relatively high temperature and high pressure compressed refrigerant through the switch over valve 222 and to the outdoor heat exchanger 216. In some embodiments, the refrigerant is a gas when discharged from compressor 226 in the cooling mode. At the heat exchanger 216 the refrigerant may transfer heat to an airflow that is passed through and/or into contact with the outdoor heat exchanger 216 by the outdoor fan 218. During this process, the refrigerant may undergo a phase change and/or temperature change. In one embodiment, the refrigerant is in a liquid state after passing through the outdoor heat exchanger 216.

After exiting the outdoor heat exchanger 216, the refrigerant may flow through the outdoor metering device 219, such that refrigerant is not substantially restricted by the outdoor metering device 219. The refrigerant generally exits the outdoor metering device 219 and flows to the indoor metering device 212, which may meter the flow of the refrigerant through the indoor metering device 212, such that the refrigerant downstream of the indoor metering device 212 is at a lower pressure than the refrigerant upstream of the indoor metering device 212. During this process, the refrigerant may undergo a phase change and/or temperature change. In some embodiments, the indoor metering device 212 changes the state of the refrigerant in the cooling cycle to a mixed state that comprises a liquid and gas mixture. In some embodiments, the mixed fluid is predominately a gas, and in others, the mixed fluid is predominately a liquid.

From the indoor metering device 212, the refrigerant may enter the indoor heat exchanger 206. As the refrigerant is passed through the indoor heat exchanger 206, heat may be transferred to the refrigerant from an airflow that is passed through and/or into contact with the indoor heat exchanger 206 by the indoor fan 209. During this process, the refrigerant may undergo a phase change and/or temperature change. In some embodiments, the refrigerant is in a gas state after passing through the indoor heat exchanger 206 in the cooling mode. The refrigerant leaving the indoor heat exchanger 212 may flow to the switch over valve 222, where the switch over valve 222 may be selectively configured to divert the refrigerant back to the compressor 226, where the refrigerant cycle may begin again.

Turning to FIG. 2B, an example schematic of a heating mode is shown. In the depicted embodiment, the direction refrigerant travels is indicated by arrows 207. Starting at compressor 226 in FIG. 2B, compressor 226 may compress the refrigerant and pump a relatively high temperature and high pressure compressed refrigerant through a switch over valve 222 and to an indoor heat exchanger 206. In some embodiments, the refrigerant is a gas when discharged from compressor 226 in the heating mode. At the heat exchanger 206, the refrigerant may transfer heat to an airflow that is passed through and/or into contact with the indoor heat exchanger 206 by an indoor fan 209. During this process, the refrigerant may undergo a phase change and/or temperature change. In one embodiment, the refrigerant is in a liquid state after passing through the indoor heat exchanger 206 in the heating mode.

After exiting the indoor heat exchanger 206, the refrigerant may flow through an indoor metering device 212, such that refrigerant is not substantially restricted by the indoor metering device 212. The refrigerant generally exits the indoor metering device 212 and flows to an outdoor metering device 219, which may meter the flow of the refrigerant through the outdoor metering device 219, such that the refrigerant downstream of the outdoor metering device 219 is at a lower pressure than the refrigerant upstream of the outdoor metering device 219. During this process, the refrigerant may undergo a phase change and/or temperature change. In one embodiment, the outdoor metering device 219 changes the state of the refrigerant in the heating circuit to a mixed state that comprises a liquid and gas mixture. In some embodiments, the mixed fluid is predominately a liquid, and in others, the mixed fluid is predominately a gas.

From the outdoor metering device 219, the refrigerant may enter an outdoor heat exchanger 216. As the refrigerant is passed through the outdoor heat exchanger 216, heat may be transferred to the refrigerant from an airflow that is passed through and/or into contact with the outdoor heat exchanger 216 by an outdoor fan 218. During this process, the refrigerant may undergo a phase change and/or temperature change. In one embodiment, the refrigerant is in a gas state after passing through the outdoor heat exchanger 216 in the heating mode. The refrigerant leaving the outdoor heat exchanger 216 may flow to a switch over valve 222, where the switch over valve 222 may be selectively configured to divert the refrigerant back to the compressor 226, where the refrigerant cycle may begin again.

FIGS. 2A and 2B also shown a schematic of an indoor unit 202 that includes mass control valves 230 coupled to the refrigerant circuit according to an example embodiment. The mass control valve 230 located proximate the inlet is considered the inlet mass control valve 230A, and the mass control valve located proximate the outlet is considered the outlet mass control valve 230B. As discussed herein, the mass control valve considered the inlet mass control valve 230A and outlet mass control valve 230B is based on the direction of the refrigerant flow, not exclusively physical location.

The indoor unit may also include temperature sensors 232, pressure sensors 234, and flow meters 246 coupled to the refrigerant circuit. In addition, in the embodiment depicted, a check valve 236 located at the compressor inlet that only allows refrigerant to flow into (and not out of) the compressor at that point in the circuit. The check valve 236 may be integral with the compressor.

Also shown in the depicted embodiment are points along the refrigerant circuit where the refrigerant either enters or exits the indoor or outdoor unit, e.g., inlets and outlets. In the depicted embodiment, points 238 and 240 are the entrance and exit points in the refrigerant cycle to indoor unit 202, and points 242 and 244 are the entrance and exit points in the refrigerant cycle to the outdoor unit 204. Whether each point (238, 240, 242, and 244) is an inlet or an outlet depends on whether the unit is in a cooling mode or heating mode, as described above.

In the depicted embodiment, mass control valves 230 are located proximate the inlet/outlet points (238 and 240) to the indoor unit 202. In the embodiments depicted in FIGS. 2A and 2B, the mass control valves 230 are located inside the indoor unit 202, proximate the inlet and outlet points (238 and 240). Locating these mass control valves 230 inside the unit may allow for a more compact design and provide some protection for the mass control valves during shipping, installation, as well as operation. In addition, locating these mass control valves 230 close to the inlet and the outlet points (238 and 240) may allow greater control of the overall mass of the refrigerant contained within the indoor unit 202.

In some embodiments, the mass control valves may be located outside the indoor unit. For example, these valves may be located just outside the indoor unit and still proximate to the inlet and outlet points. In other examples, the mass control valves may be located inside the outdoor unit, potentially proximate the inlet/outlet points to the outdoor unit, potentially for retro-fit designs and/or redundancy. In some examples, the mass control valves are located along the portion of the refrigerant circuit connecting the indoor unit to the outdoor unit, potentially to allow access to the mass control valves and/or because of space constraints.

It is understood that more or less mass control valves may be used with the disclosure set forth herein. For example, the indoor metering device 212 may be used as the mass control valve in some embodiments. In these examples, the indoor metering device may control the refrigerant flow based on the conditioned load, and it also may control the mass of refrigerant as described in more detail below. In these examples, during the cooling mode, the refrigerant circuit is setup such that the metering device 212 may close fully, which may terminate the supply of refrigerant into the indoor unit. In some examples, the check valve 236 may also serve to control the mass of refrigerant in the indoor unit. In these examples, the check valve 236 may allow one directional refrigerant flow in to the compressor. When the HVAC system 100 is configured in cooling mode, the indoor metering device 212 may contain a desired mass of refrigerant between the metering device 212 and the check valve 236.

In some embodiments, additional mass control valves may also be used. For example, mass control valves may be located at the inlet and outlet of both the indoor unit and the outdoor unit. Other configurations are also contemplated for use with the disclosure herein.

The mass control valves may be any standard valve capable of modulating and controlling the flow of refrigerant. In the embodiment depicted in FIGS. 2A and 2B, the mass control valves 230 are solenoid valves. In some examples, the mass control valve may be an electronically-controlled motor driven EEV. In some embodiments where multiple mass control valves are used, the mass control valves may be different types.

FIGS. 2A and 2B also shows additional components that may be included in embodiments of the present disclosure. For example, the depicted embodiment illustrates a system controller 106, an indoor controller 124 and an outdoor controller 126 discussed above. As discussed in more detail below, the control circuitry 400 (see FIG. 4) may include some or all of the system controller 106, the indoor controller 124, and the outdoor controller 126, and the control circuitry 400 may control the various devices and components associated with the HVAC system 100.

The control circuitry 400 may be operably coupled to various devices and components within the HVAC system 100 including the indoor unit 102 and the outdoor unit 104. In some embodiments, the control circuitry may be configured to control these various devices and components to mitigate the impact of a refrigerant leak before the leak is detected. In some embodiments, the control circuitry is not coupled to a device for sensing refrigerant leaks, and in these embodiments, the control circuitry is still configured to mitigate the risk associated with refrigerant leaks. In some embodiments, the control circuitry is configured to operate the HVAC system to address a conditioning load by circulating refrigerant and operating the indoor fan 209, control the mass of refrigerant in the indoor unit using one or more mass control valve(s) 230, and completely closing at least one mass control valve to terminate the supply of refrigerant to the indoor unit in response to the indoor fan being shut off. The below discusses each of these features in more detail.

In some embodiments, the control circuitry 400 may operate the HVAC system 100 to satisfy a conditioning load. As discussed above, the conditioning load is typically based on the difference between a desired temperature in a conditioned space and the actual temperature in the space. For example, the conditioned load may be based on the difference between the temperature measured within a space by a thermostat and the temperature setpoint for this space. If the difference between these values is above a given threshold, the HVAC system may operate in either a cooling mode or a heating mode to satisfy this conditioned load.

In some embodiments, the control circuitry 400 may operate the HVAC system 100 by circuiting the refrigerant through the refrigerant circuit, potentially using the compressor 226. During this operation, the control circuitry may also operate the indoor fan 209 to circulate conditioned air. As described above, circulating the refrigerant through the refrigerant circuit transfers heat between the indoor unit 202 and the outdoor unit 204. This transfer typically leads to either cool refrigerant passing through the indoor heat exchanger 206 during a cooling mode, or hot refrigerant passing through the indoor heat exchanger during a heating mode. In either case, the control circuitry may operate the indoor fan to circulate conditioned air to the space in order to remove (or provide) thermal energy to satisfy the conditioning load. In addition, the control circuitry may also circulate the refrigerant through the refrigeration circuit to allow the indoor heat exchanger to transfers thermal energy between the conditioned air and the refrigerant, ensuring that the conditioned air is at the appropriate temperature to satisfy the conditioning load.

In some embodiments, the control circuitry 400 may also control the mass of refrigerant in the indoor unit 202. As discussed above, the flow of refrigerant in an HVAC system 100 may be driven through the refrigerant circuit based on the conditioned load. The control circuitry may also control the mass of refrigerant within the indoor unit, which may include controlling the flow of refrigerant through the HVAC system and potentially overriding or supplementing the flow of refrigerant controls directed to satisfying the conditioning load.

In some embodiments, the control circuitry 400 may control the flow of refrigerant such that there is less than a given mass threshold value in the indoor unit. In some embodiments, the given mass threshold value is based on safety concerns and/or regulations, and in some embodiments, the given mass threshold value may be approximately 4 pounds. The given mass threshold value of refrigerant permitted in the indoor unit may also be based on the type of refrigerant used. For example, if the refrigerant is flammable or potentially has a higher concentration of combustible fuel, then a lower mass threshold value of refrigerant may be permitted in the indoor unit. The location of the indoor unit may also impact the mass threshold value of refrigerant permitted in the indoor unit. For example, the air circulated through the indoor unit by the indoor fan may impact the given mass threshold value, typically raising the value. Similarly, the air circulation around the indoor unit may also impact the given mass threshold value, again typically raising the value. In some embodiments, the mass threshold value may be based on the capacity of the unit. For example, larger units may have higher mass threshold values because the system may include larger fans for mitigating the impact of a leak. In other examples, the units with greater capacity may have lower mass threshold values to allow for tighter control of the refrigerant given the greater total amount of refrigerant present.

It is also noted that mass of refrigerant is used as the metric for determining the amount of refrigerant present within the indoor unit in some embodiments. This metric may be used because the refrigerant often changes phases, impacting its density, volume, etc. However, it is understood that metrics other than mass may be used with the devices and methods disclosed herein, provided they provide an accurate indication of the amount of refrigerant present, and thus an indication of the harmful impact that that amount of refrigerant may cause if leaked.

In some embodiments, the control circuitry 400 may control the mass of refrigerant in the indoor unit 202 by closing one or more mass control valves 230 to terminate the supply of refrigerant to the indoor unit in response to the indoor fan 209 being shut off. In some embodiments, the inlet mass control valve 230A is closed to terminate the supply of refrigerant to the indoor unit 202. In some examples this operation may be sufficient to control the mass of refrigerant within the indoor unit. For example, when the HVAC system 100 is operating in a cooling mode, the refrigerant passing through the indoor unit may be converted to a gas at the indoor heat exchanger 206 as the refrigerant receives thermal energy from the conditioning air. This heat transfer and phase change typically occur when the indoor fan is operational. When the refrigerant becomes a gas the phase change may lead to higher pressure which may drive the refrigerant out of the indoor unit. The gas refrigerant may also be lighter than the liquid refrigerant, and thus, when all or substantially all of the refrigerant is converted to a gas at the indoor heat exchanger, the indoor unit may only have a limited mass of refrigerant present.

The above phase change may be used by some embodiments of the HVAC system 100 to control the mass of refrigerant in the indoor unit 202. These embodiments may be particularly applicable when the HVAC system is operating in cooling mode, and the control circuitry 400 may control the mass control valve(s) 230 based on the operation of the indoor fan. For example, in some embodiments, one or more of the mass control valves is fully closed when the indoor fan 209 is not operating, which may not allow any refrigerant to flow into the indoor unit. When the indoor fan is operating, potentially to satisfy a cooling load, the mass control valve(s) may open to allow refrigerant to flow into the indoor unit and circulate through the indoor metering device 212 and indoor heat exchanger 206. While the indoor fan is operating, the refrigerant may be converted to a gas at the indoor heat exchanger, and as discussed above, this may ensure that the refrigerant is both maintained at a low mass and flows out of the indoor unit. In some embodiments, when the indoor fan is shut off, one or more of the mass control valve closes terminating the supply of refrigerant to the indoor unit. In some embodiments, the inlet mass control valve closes to terminate the supply of refrigerant when the indoor fan is shut off. In some embodiments, the indoor fan may be shut off while a conditioning load still exists, and in these embodiments, the one or more mass control valve(s) may still fully close. In these embodiments, the control circuitry may also override and/or cancel some or all of the other commands directing the other system components to circulate refrigerant to satisfy the conditioning load, e.g. shutting off the compressor, etc.

In some embodiments, this control may be sufficient, particularly during cooling mode, to control the mass of refrigerant within the indoor unit to below a given mass. As discussed above, this is because the refrigerant entering the indoor unit is converted to a gas and flows out of the indoor unit, leaving only a limited mass remaining within the unit at any given time.

In some embodiments, the control circuitry 400 is configured such that the mass control valve(s) 230 is electrically connected to the indoor fan 209. In some embodiments, the indoor fan and the inlet mass control valve 230A and/or the outlet mass control valve 230B may be wired in series such that each component is energized and deenergized jointly. For example, the mass control valve(s) may be a normally closed solenoid valve. The mass control valve(s) may be wired in series with the indoor fan, and/or the indoor fan relay (not shown), such that the solenoid valve(s) opens when the indoor fan is running. When the indoor fan is shut off, the solenoid is powered down and closes to terminate the supply of refrigerant within the indoor unit. In some embodiments, the indoor metering device is used as the mass control valve, which may provide a cost efficient design. Other configurations may also be used.

In some embodiments, the control circuitry 400 controls the mass control valve(s) 230 to control the flow of refrigerant through additional processes as well. For example, the control circuitry may modulate the mass control valve(s) to actively adjust the flow of refrigerant. This may include modulating the mass control valve(s) to fully open, fully closed, and/or partially opened as described herein. In some examples, this modulation may include cycling the mass control valve(s) between fully open and fully closed to control the overall flow rate of the refrigerant. In some embodiments, this cycling may be performed on a duty cycle, and it may be controlled to permit a certain flow rate through the mass control valve(s). In some embodiments, modulating the mass control valve(s) includes partially opening a given mass control valve to allow a limited amount of refrigerant to flow through the mass control valve, and in some embodiments, the partial opening may be designed to allow only a given flow rate through the mass control valve. These and other controls may be used to modulate the flow rate of refrigerant through the mass control valve(s), including any standard flow control method or mechanism.

In some embodiments, the control circuit 400 may control the mass of refrigerant within the indoor unit 202 using two mass control valves 230. In some embodiments this may include an inlet mass control valve 230A located at the inlet to the indoor unit 202, potentially a first mass control valve, and an outlet mass control valve 230B located at the outlet from the indoor unit, potentially a second mass control valve. As discussed above, the mass control valve considered to be at the inlet may change based on whether the HVAC system 100 is operating in a cooling mode or a heating mode. The inlet mass control valve 230A may control the flow of refrigerant into the indoor unit 202. Similarly, the mass control valve considered to be at the outlet may also change based on the operating mode of the HVAC system. The outlet mass control valve 230B may control the flow of refrigerant out of the indoor unit 202, and in some embodiments, it may prevent any backflow of refrigerant into the indoor unit. Unless specified otherwise, the controls and processes described herein will generally apply to the mass control valves location relative to the refrigerant flow and not the mass control valves physical location. Stated another way, the mass control valve that controls the refrigerant into the indoor unit during a given operating mode will be considered the inlet mass control valve 230A, and conversely the mass control valve that controls the flow of refrigerant out of the indoor unit during a given operating mode will be considered the outlet mass control valve 230B.

In some examples, the control circuitry 400 may control the mass of refrigerant in the indoor unit 202 by modulating the inlet mass control valve 230A and/or modulating the outlet mass control valve 230B. This may include modulating the inlet mass control valve to adjust the flow rate of refrigerant into the indoor unit, and/or it may include modulating the outlet mass control valve to adjust the flow rate of refrigerant out of the indoor unit. By controlling the flow rate into and/or out of the indoor unit the control circuitry may control the mass of refrigerant within the unit. For example, the mass control valves may be controlled such that the flow rate of refrigerant through the inlet to the indoor unit is equal to or less than the flow rate of refrigerant through the outlet of the indoor unit. In some examples, the control circuitry may permit the flow rate into the indoor unit to be greater than the flow rate out of the unit, and in these examples, the control circuitry may allow this net inflow of refrigerant into the indoor unit for only a certain amount of time or when the net inflow of refrigerant is sufficiently small.

In some embodiments, the control circuitry 400 modulates the flow rate using a single mass control valve 230, at least for a portion of the time or for a particular mode of operation. For example, the HVAC system 100 may include two mass control valves, an inlet mass control valve 230A and an outlet mass control valve 230B, and the control circuitry may fix the position of one of these mass control valves and use the other mass control valve to control the flow rate of refrigerant within the indoor unit. In some of these examples, the control circuitry may control the outlet mass control valve to be fully open, and the control circuitry may modulate the flow rate of refrigerant in the indoor unit by modulating the inlet mass control valve. In some examples, the control circuitry may operate in reverse, potentially fully closing the inlet mass control valve and modulating the outlet mass control valve to control the flow rate of refrigerant out of the indoor unit. In other examples, the HVAC system may only include a single mass control valve that modulates the flow of refrigerant to control the mass of refrigerant within the indoor unit. In these embodiments, the mass control valve may be an inlet mass control valve to control the flow rate of refrigerant into the indoor unit. In other embodiments, the mass control valve may be an outlet mass control valve. Other configurations may also be utilized.

In some embodiments, by controlling the flow rates the control circuitry 400 may control the mass of refrigerant within the indoor unit 202 and ensure this mass is below a given mass threshold value. In some embodiments, the control circuitry 400 is coupled to sensors or features for confirming that the flow rate of refrigerant into (and through) the indoor unit is sufficiently controlled to ensure the mass of refrigerant within the indoor unit is below the given mass threshold value. For example, as discussed above, when the refrigerant is converted to a gas at the indoor heat exchanger during the cooling mode, the mass of refrigerant within the indoor unit will be low. In most embodiments, when the refrigerant is converted to gas or a predominately gas mixture after passing through the indoor heat exchanger the mass of refrigerant will be below a desired mass, including below 4 lbs. In some embodiments, the HVAC system is calibrated and/or sized to confirm that when the refrigerant is converted to a gas by the indoor heat exchanger, the mass of refrigerant within the indoor unit is below a desired or given mass. This may include identifying the size of the given unit. For example, the calibration process may identify that all HVAC systems sized at 5 tons or less will have less than a given mass of refrigerant in the indoor unit, potentially less than 4 pounds, when all of the refrigerant is converted to gas at the indoor heat exchanger. In some embodiments, the calibration may also include identifying the percentage of refrigerant that must be converted to a gas by the indoor heat exchanger to maintain mass of refrigerant below the given mass threshold value. Other process and/or calibrations techniques may be used, including identifying the distance the mass control valve may be from the inlet to the indoor unit, identifying the appropriate size of the refrigerant piping within the indoor unit, along with other techniques.

In some embodiments, the control circuitry 400 controls the mass of refrigerant in the indoor unit 202 by modulating one of a first or a second mass control valve 230 based on measurements received from one of either a pressure sensor 234 or a temperature sensor 232. The first and second mass control valve may be an inlet mass control valve 230A and/or an outlet mass control valve 230B. In these embodiments, the control circuitry may be coupled to a temperature sensor and/or a pressure sensor, which each may also be coupled to the refrigerant circuit. In some embodiments, the temperature sensor and/or the pressure sensor may each provide an indication that the refrigerant has been converted to a gas or a predominately gas mixture at the indoor heat exchanger.

In some embodiments as shown in FIGS. 2A and 2B, the temperature sensor 232 and/or the pressure sensor 234 may be located downstream of the indoor heat exchanger, potentially within the indoor unit itself. In these examples, the phase of the refrigerant may be determined based on the type of refrigerant and these valves using a standard look up table, and in some of these embodiments, this includes determining the percentage of the refrigerant that is a gas. In other embodiments, the phase of the refrigerant may be approximated based on the pressure and/or the temperature individually. For example, if the measured pressure of the refrigerant is above a given value after exiting the indoor heat exchanger, the control circuitry 400 may know that a sufficient percentage of the refrigerant has been converted to a gas. Similarly, if the measured temperature is above a given value after existing the indoor heat exchanger, the control circuitry may know that a sufficient percentage of the refrigerant has been converted to a gas. In addition, more complex methods may be used that rely on temperature and/or pressure throughout the system, superheat, and/or subcooling of the refrigerant to provide a reliable indicator of the whether a sufficient percentage of refrigerant has been converted to gas at the indoor heat exchanger.

In some embodiments, the control circuitry 400 may modulate the mass control valve(s) 230 based on the pressure and/or temperature measurements received. In some embodiments, the control circuitry uses the pressure and/or temperature measurement as discussed above to determine if a sufficiently high percentage of refrigerant has been converted to gas at the indoor heat exchanger 206. If all of the refrigerant has been converted to gas, then the control circuitry may not adjust the mass control valve(s). In addition, if the temperature and/or pressure measurements indicated that a sufficiently high percentage of refrigerant has been converted to a gas, then the control circuitry may not adjust the mass control valve(s). If the temperature and/or pressure measurements indicate that an insufficient percentage of the refrigerant has been converted to a gas, then the control circuitry may modulate the mass control valve(s). In some embodiments, the control circuitry modulates the mass control valve(s) to reduce the flow rate of refrigerant into the indoor unit. In some embodiments, the control circuitry may continue to reduce the flow rate of refrigerant into the indoor unit until the temperature and/or pressure measurements indicate that a sufficiently high percentage of refrigerant has been converted to gas at the indoor heat exchanger.

In some embodiments, the control circuitry 400 may monitor the flow rate of refrigerant into the indoor unit 202, potentially a first flow rate, and/or the flow rate of refrigerant out of the indoor unit, potentially a second flow rate. In some embodiments, one or more flow meters 246 is coupled to the refrigerant circuit to monitor these flow rate(s). The flow meter(s) may be located proximate the inlet to the indoor unit and/or the outlet from the indoor unit as shown in FIGS. 2A and 2B. In some embodiments, a flow meter coupled to the refrigerant circuit after the indoor heat exchanger, e.g., downstream from the heat exchanger in cooling mode, may provide an indication of the fluid flow at the inlet/outlet point after the indoor heat exchanger. In some embodiments a flow meter coupled to the refrigerant circuit upstream of the indoor meter device, e.g., upstream of the indoor meter device in a cooling mode, may provide an indication of the fluid flow at the inlet/outlet point before the indoor metering device.

Any conventional flow meter may be used, including differential pressure meters, turbines, positive displacement meters, optical or ultrasonic meters, etc. In addition, more complex techniques for monitoring flow based on the temperature and pressure sensors located through the HVAC system 100 may also be used to determine the flow rate.

In some embodiments, the control circuitry 400 controls the mass of refrigerant within the indoor unit 202 by modulating the mass control valve(s) 230 based on the flow rate(s) determined by the flow meter 246. In some embodiments, this includes modulating the inlet mass control valve 230A to reduce the first flow rate of refrigerant into the indoor unit in response to the first flow rate being greater than the second flow rate. In some embodiments, the control circuitry modulates the outlet mass control valve 230B to increase the flow rate out of the unit in response to the first flow rate being greater than the second flow rate.

In some embodiments, the control circuitry 400 automatically modulates either the inlet or the outlet mass control valve (230A or 230B), e.g., the first or second mass control valves, in response to the first flow rate being greater than the second flow rate. In other embodiments, the control circuitry takes into account other factors and/or delays this process. For example, the control circuitry may reduce the first flow rate when the first flow rate is greater than the second flow rate for a given period of time. This period of time may be set for the HVAC system 100 and may be based on various calibration factors discussed above, e.g., pipe size, pipe length, tonnage, operating mode, etc. In some examples, the control circuitry may reduce the first flow rate when the first flow rate is greater than the second flow rate by a certain amount. This amount may also be set for the HVAC system based on the calibration processes discussed herein. In some embodiments, the control circuitry provides an alert when the first flow rate is greater than the second flow rate for a threshold period of time. The threshold period of time may be determined through calibration techniques discussed above, and it may be greater or less than the period of time used to determine if the first flow rate should be reduced. This alert may be published on the display and/or an alarm may sound. In some embodiments, the control circuitry turns on the indoor fan 209 if it was not previously operating.

In some embodiments, the control circuitry 400 may control additional components within the HVAC system 100 when the control circuitry closes the mass control valve(s) 230. For example, the control circuitry may open the indoor metering device 212 in response to the closing of at least one mass control valve to terminate the supply of refrigerant to the indoor unit 202. In some embodiments, this may include fully opening the indoor metering device. In embodiments, that include two mass control valves, the control circuitry may open, and potentially fully open, the outlet mass control valve in response to the inlet mass control valve closing. In some of these embodiments, the outlet mass control valve is only opened for a limited amount of time after the inlet mass control valve closes.

FIGS. 3A, 3B, 3C, 3D, 3E, and 3F are flowcharts illustrating various steps in a method 300 of mitigating the impact of refrigerant leaks prior to leaks being detected in HVAC system 100, according to various example implementations of the present disclosure. The method 300 includes circulating a refrigerant in a refrigerant circuit between an indoor and an outdoor unit (202 and 204) to satisfy a conditioning load, as shown in block 302 of FIG. 3A. The method may also include operating an indoor fan 209 in response to the conditioning load, as shown in block 304. The method may also include closing the mass control valve to terminate a supply of refrigerant to the indoor unit in response to the indoor fan being shut off, as shown in block 306.

In some embodiments, controlling the mass of refrigerant in the indoor unit 202 to maintain less than a given mass threshold value of refrigerant in the indoor unit, as shown in block 308 of FIG. 3B. This given mass threshold value may be approximately 4 pounds.

In some embodiments, controlling the mass of refrigerant in the indoor unit 202 by modulating the mass control valve 230 based on measurements received from one of a pressure sensor 234 or a temperature sensor 232, as shown in block 310 of FIG. 3C.

In some embodiments, the mass control valve 230 comprises a first mass control valve, potentially an inlet mass control valve 230A located at a refrigerant inlet to the indoor unit and spaced apart from an indoor metering device 212, and the method 300 further includes controlling the mass of refrigerant by modulating the first mass control valve at a refrigerant inlet and modulating a second mass control valve, potentially an outlet mass control valve 230B, at a refrigerant outlet from the indoor unit, as shown in block 312 of FIG. 3D.

In some embodiments, the method 300 further comprises monitoring a first flow rate of refrigerant into the indoor unit 202 and a second flow rate of refrigerant out of the indoor unit, as shown in block 314 of FIG. 3E. The method may also include controlling the mass of refrigerant by modulating the mass control valve 230 to reduce the first flow rate of refrigerant into the indoor unit in response to the first flow rate being greater than the second flow rate, as shown in block 316 of FIG. 3E. In some embodiments, the method may include reducing the first flow rate when the first flow rate is greater than the second flow rate for one of a given period of time or by a certain amount, as shown in block 318. In some embodiments, the method includes providing an alert when the first flow rate is greater than the second flow rate for a threshold period of time, as shown in block 320.

In some embodiments, the method 300 further comprises opening an indoor metering device in response to the closing of the mass control valve, as shown in block 322 of FIG. 3F.

FIG. 4 illustrates the control circuitry 400 according to some example embodiments of the present disclosure. The control circuitry may include one or more of each of a number of components such as, for example, a processor 402 connected to a memory 404. The processor is generally any piece of computer hardware capable of processing information such as, for example, data, computer programs and/or other suitable electronic information. The processor includes one or more electronic circuits some of which may be packaged as an integrated circuit or multiple interconnected integrated circuits (an integrated circuit at times more commonly referred to as a "chip"). The processor 402 may be a number of processors, a multi-core processor or some other type of processor, depending on the particular embodiment.

The processor 402 may be configured to execute computer programs such as computer-readable program code 406, which may be stored onboard the processor or otherwise stored in the memory 404. In some examples, the processor may be embodied as or otherwise include one or more ASICs, FPGAs or the like. Thus, although the processor may be capable of executing a computer program to perform one or more functions, the processor of various examples may be capable of performing one or more functions without the aid of a computer program.

The memory 404 is generally any piece of computer hardware capable of storing information such as, for example, data, computer-readable program code 406 or other computer programs, and/or other suitable information either on a temporary basis and/or a permanent basis. The memory may include volatile memory such as random access memory (RAM), and/or non-volatile memory such as a hard drive, flash memory or the like. In various instances, the memory may be referred to as a computer-readable storage medium, which is a non-transitory device capable of storing information. In some examples, then, the computer-readable storage medium is non-transitory and has computer-readable program code stored therein that, in response to execution by the processor 402, causes the control circuitry 400 to perform various operations as described herein, some of which may in turn cause the HVAC system to perform various operations.

In addition to the memory 404, the processor 402 may also be connected to one or more peripherals such as a network adapter 408, one or more input/output (I/O) devices 410 or the like. The network adapter is a hardware component configured to connect the control circuitry 400 to a computer network to enable the control circuitry to transmit and/or receive information via the computer network. The I/O devices may include one or more input devices capable of receiving data or instructions for the control circuitry, and/or one or more output devices capable of providing an output from the control circuitry. Examples of suitable input devices include a keyboard, keypad or the like, and examples of suitable output devices include a display device such as a one or more light-emitting diodes (LEDs), a LED display, a liquid crystal display (LCD), or the like.

Many modifications and other embodiments of the disclosure set forth herein will come to mind to one skilled in the art to which the disclosure pertains having the benefit of the teachings presented in the foregoing description and the associated figures. Therefore, it is to be understood that the disclosure is not to be limited to the specific embodiments disclosed and that modifications and other embodiments are intended to be included within the scope of the appended claims. Moreover, although the foregoing description and the associated figures describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A heating, ventilation and air conditioning (HVAC) system operable to mitigate refrigerant leaks before leaks are detected, the HVAC system comprising:

an indoor unit including an indoor fan and an indoor heat exchanger;

an outdoor unit including an outdoor heat exchanger and a compressor;

a refrigerant circuit including a refrigerant circulated between the indoor unit and the outdoor unit;

a normally closed solenoid valve coupled to the refrigerant circuit and arranged to control the flow of refrigerant to the indoor heat exchanger, wherein the normally closed solenoid valve is electrically connected in series with the indoor fan such that the normally closed solenoid valve opens in response to the fan receiving power to allow refrigerant to flow into the heat exchanger and closes in response to the fan powering off, wherein closing the normally closed solenoid valve blocks the flow of refrigerant into the heat exchanger;

an indoor metering device configured to adjust a refrigerant flow based on the conditioning load, the indoor metering device located a distance from the normally closed solenoid valve; and control circuitry configured to:

operate the HVAC system to satisfy a conditioning load by circulating the refrigerant through the refrigerant circuit and operating the indoor fan, wherein powering off the indoor fan closes the normally closed solenoid valve to block the flow of the refrigerant from the compressor to the indoor heat exchanger.

2. The HVAC system of claim 1, wherein the control circuitry is not coupled to a device for sensing refrigerant leaks.

3. The HVAC system of claim 1, wherein the indoor metering device is located within the indoor unit between the normally closed solenoid valve and the indoor heat exchanger.

4. The HVAC system of claim 1, wherein the normally closed solenoid valve comprises a first normally closed solenoid valve located at a refrigerant inlet to the indoor unit, and the HVAC system further comprises a second normally closed solenoid valve located at a refrigerant outlet from the indoor unit and spaced apart from the indoor metering device, wherein the second normally closed solenoid valve is wired in series with the first normally closed solenoid valve and the indoor fan.

5. The HVAC system of claim 1, wherein the normally closed solenoid valve is located upstream of the indoor heat exchanger when the refrigerant is circulating in a cooling mode.

6. The HVAC system of claim 1, wherein the normally closed solenoid valve is located in the indoor unit.

7. The HVAC system of claim 2, wherein the control circuitry is not configured to make a determination that a refrigerant leak has occurred.

8. The HVAC system of claim 3, wherein the control circuitry is further configured to override any commands to the indoor metering device based on the conditioning load and completely close the indoor metering device in response to the indoor fan being shut off.

9. A heating, ventilation and air conditioning (HVAC) system operable to mitigate refrigerant leaks before leaks are detected, the HVAC system comprising:

an indoor unit including an indoor fan and an indoor heat exchanger;

a furnace coupled to the indoor unit;

an outdoor unit including an outdoor heat exchanger and a compressor;

a refrigerant circuit including a refrigerant circulated between the indoor unit and the outdoor unit;

a normally closed solenoid valve coupled to the refrigerant circuit and arranged to control the flow of refrigerant to the indoor heat exchanger, wherein the normally closed solenoid valve is electrically connected in series with the indoor fan such that the normally closed solenoid valve opens in response to the fan receiving power to allow refrigerant to flow into the heat exchanger and closes in response to the fan powering off, wherein closing the normally closed solenoid valve blocks the flow of refrigerant into the heat exchanger;

an indoor metering device configured to adjust a refrigerant flow based on the conditioning load, the indoor metering device located a distance from the normally closed solenoid valve; and control circuitry configured to:

operate the HV AC system to satisfy a cooling conditioning load by circulating the refrigerant through the refrigerant circuit and operating the indoor fan, wherein powering off the indoor fan closes the normally closed solenoid valve to block the flow of the refrigerant from the compressor to the indoor heat exchanger.

10. The HVAC system of claim 9, wherein the control circuitry is not coupled to a device for sensing refrigerant leaks.

11. The HVAC system of claim 9, wherein the furnace is a gas-fired furnace.

12. The HVAC system of claim 9, wherein the normally closed solenoid valve comprises a first normally closed solenoid valve located at a refrigerant inlet to the indoor unit, and the HVAC system further comprises a second normally closed solenoid valve located at a refrigerant outlet from the indoor unit and spaced apart from the indoor metering device, wherein the second normally closed solenoid valve is wired in series with the first normally closed solenoid valve and the indoor fan.

13. The HVAC system of claim 9, wherein the normally closed solenoid valve is located upstream of the indoor heat exchanger when the refrigerant is circulating in a cooling mode.

14. The HVAC system of claim 9, wherein the normally closed solenoid valve is located in the indoor unit.

15. A method of mitigating the impact of refrigerant leaks prior to leaks being detected, the method comprising:

circulating a refrigerant in a refrigerant circuit between an indoor unit that includes an indoor fan and an indoor heat exchanger and an outdoor unit that includes an outdoor heat exchanger and a compressor to satisfy a conditioning load, wherein the indoor unit includes an indoor metering device configured to adjust a refrigerant flow based on the conditioning load;

operating the indoor fan in response to the conditioning load; and closing a normally closed solenoid valve to block the flow of the refrigerant to the indoor heat exchanger in response to the indoor fan being shut off, wherein the normally closed solenoid valve is electrically connected in series with the indoor fan such that the normally closed solenoid valve opens in response to the fan receiving power to allow refrigerant to flow into the heat exchanger and closes in response to the fan powering off to block the flow of refrigerant into the heat exchanger, wherein the normally closed solenoid valve is located a distance from the indoor metering device.

16. The method of claim 15, further comprising controlling a mass of refrigerant in the indoor unit to maintain less than a given mass threshold value of refrigerant in the indoor unit.

17. The method of claim 15, wherein the normally closed solenoid valve is a first normally closed solenoid valve, and the method further includes controlling a mass of refrigerant in the indoor unit by closing the first normally closed solenoid valve at a refrigerant inlet to the indoor unit and closing a second normally closed solenoid valve at a refrigerant outlet from the indoor unit, wherein the second normally closed solenoid valve is wired in series with the first normally closed solenoid valve and the indoor fan.

18. The method of claim 15, further comprising opening an indoor metering device in response to the closing of the normally closed solenoid valve.

19. The method of claim 15, wherein the normally closed solenoid valve is located upstream of the indoor heat exchanger when the refrigerant is circulating in a cooling mode.

20. The method of claim 16, wherein the given mass threshold value is approximately 4 pounds.

* * * * *